US011643878B2

(12) United States Patent
Li et al.

(10) Patent No.: US 11,643,878 B2
(45) Date of Patent: May 9, 2023

(54) DEPLOYING MATERIAL TO LIMIT LOSSES OF DRILLING FLUID IN A WELLBORE

(71) Applicant: Saudi Arabian Oil Company, Dhahran (SA)

(72) Inventors: Bodong Li, Dhahran (SA); Chinthaka Pasan Gooneratne, Dhahran (SA); Timothy E. Moellendick, Dhahran (SA); Rami F. Saleh, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 389 days.

(21) Appl. No.: 16/831,559

(22) Filed: Mar. 26, 2020

(65) Prior Publication Data

US 2021/0301597 A1 Sep. 30, 2021

(51) Int. Cl.
*E21B 10/32* (2006.01)
*E21B 17/10* (2006.01)
(Continued)

(52) U.S. Cl.
CPC ..... *E21B 10/32* (2013.01); *E21B 17/1014* (2013.01); *E21B 17/1057* (2013.01);
(Continued)

(58) Field of Classification Search
CPC .. E21B 10/034; E21B 10/345; E21B 17/1014; E21B 17/1057; E21B 21/003
See application file for complete search history.

(56) References Cited

U.S. PATENT DOCUMENTS 1,862,629 A * 6/1932 Morrison ..... E21B 10/34 175/335
2,121,888 A * 6/1938 Smith ..... E21B 10/34 15/104.18
(Continued)

FOREIGN PATENT DOCUMENTS

AU 2003258046 A1 * 2/2004 ..... E21B 33/127
CN 104499946 A * 4/2015 ..... E21B 10/322
(Continued)

OTHER PUBLICATIONS

Corona et al., "Novel Washpipe-Free ICD Completion With Dissolvable Material," OTC-28863-MS, presented at the Offshore Technology Conference, Houston, TX, Apr. 30-May 3, 2018; 2018, OTC, 10 pages.
(Continued)

*Primary Examiner* — Robert E Fuller
*Assistant Examiner* — Neel Girish Patel
(74) *Attorney, Agent, or Firm* — Fish & Richardson P.C.

(57) ABSTRACT

Bottom hole assemblies with a combined roller-underreamer assembly can include: a body configured to be attached to a drill pipe; an uphole ring attached to the body; a downhole ring attached to the body between the uphole ring and the downhole end of the body; a sliding ring mounted around the body between the uphole ring and the downhole ring; a set tube slidably mounted around the body between the uphole ring and the sliding ring; a reamer assembly with at least one first articulated arm with extending between the uphole ring and the downhole end of the set tube; and a roller assembly with: at least one second articulated arm extending between the uphole end of the set tube and the sliding ring; and a rolling positioned at a joint of each second articulated arm.

19 Claims, 35 Drawing Sheets

(51) Int. Cl.
*E21B 21/00* (2006.01)
*E21B 10/34* (2006.01)

(52) U.S. Cl.
CPC ..... *E21B 10/325* (2013.01); *E21B 10/34* (2013.01); *E21B 10/345* (2013.01); *E21B 21/003* (2013.01)

(56) References Cited

U.S. PATENT DOCUMENTS 2,450,223 A * 9/1948 Barbour ..... E21B 10/32 175/401
2,927,775 A 3/1960 Hildebrandt
3,028,915 A 4/1962 Jennings
3,102,599 A * 9/1963 Hillburn ..... E21B 43/103 166/387
3,656,564 A 4/1972 Brown
4,064,211 A 12/1977 Wood
4,191,493 A 3/1980 Hansson et al.
4,270,618 A * 6/1981 Owens ..... E21B 10/34 175/173
4,365,677 A * 12/1982 Owens ..... E21B 7/002 175/173
4,464,993 A 8/1984 Porter
4,501,337 A 2/1985 Dickinson et al.
5,388,648 A 2/1995 Jordan, Jr.
5,429,198 A 7/1995 Anderson et al.
5,501,248 A 3/1996 Kiest, Jr.
5,590,724 A * 1/1997 Verdgikovsky ..... E21B 7/28 175/57
5,803,666 A 9/1998 Keller
5,853,049 A 12/1998 Keller
RE36,362 E 11/1999 Jackson
6,012,526 A 1/2000 Jennings et al.
6,170,531 B1 1/2001 Jung et al.
6,371,306 B2 4/2002 Adams et al.
6,561,269 B1 5/2003 Brown et al.
6,575,255 B1 * 6/2003 Rial ..... E21B 10/32 175/57
6,637,092 B1 10/2003 Menzel
6,722,452 B1 * 4/2004 Rial ..... E21B 21/10 175/57
6,902,014 B1 * 6/2005 Estes ..... E21B 10/086 175/391
7,387,174 B2 6/2008 Lurie
7,455,117 B1 11/2008 Hall et al.
7,789,148 B2 9/2010 Rayssiguier et al.
8,176,977 B2 5/2012 Keller
8,567,491 B2 10/2013 Lurie
9,470,059 B2 10/2016 Zhou
9,757,796 B2 9/2017 Sherman et al.
9,903,010 B2 2/2018 Doud et al.
9,976,381 B2 5/2018 Martin et al.
10,233,372 B2 3/2019 Ramasamy et al.
10,352,125 B2 7/2019 Frazier
2002/0040812 A1 4/2002 Keying et al.
2003/0159776 A1 8/2003 Graham
2006/0185843 A1 8/2006 Smith
2007/0017669 A1 1/2007 Lurie
2009/0178809 A1 7/2009 Jeffryes et al.
2009/0178852 A1 * 7/2009 Zeni ..... E21B 10/38 175/57
2009/0183875 A1 7/2009 Rayssiguier et al.
2009/0255689 A1 10/2009 Kriesels et al.
2010/0175882 A1 7/2010 Bailey et al.
2010/0224414 A1 * 9/2010 Radford ..... E21B 10/322 175/57
2011/0005836 A1 * 1/2011 Radford ..... E21B 17/1078 175/57
2011/0056703 A1 * 3/2011 Eriksen ..... E21B 34/00 166/344
2011/0120732 A1 * 5/2011 Lurie ..... E21B 43/103 166/208
2011/0127044 A1 * 6/2011 Radford ..... E21B 47/12 166/212
2011/0220350 A1 9/2011 Daccord et al.
2011/0220416 A1 9/2011 Rives
2012/0111578 A1 5/2012 Tverlid
2013/0068481 A1 * 3/2013 Zhou ..... E21B 23/04 166/207
2013/0299241 A1 11/2013 Alberty et al.
2014/0158369 A1 * 6/2014 Radford ..... E21B 23/10 166/373
2014/0231068 A1 8/2014 Isaksen
2015/0020908 A1 1/2015 Warren
2015/0159467 A1 6/2015 Hartman et al.
2015/0308250 A1 * 10/2015 Anders ..... E21B 34/06 166/308.1
2016/0032710 A1 * 2/2016 Hu ..... E21B 47/08 33/544.2
2016/0160106 A1 6/2016 Jamison et al.
2017/0175446 A1 6/2017 Fraser et al.
2018/0010030 A1 1/2018 Ramasamy et al.
2018/0086962 A1 3/2018 Amanullah
2018/0187492 A1 * 7/2018 Amri ..... E21B 21/003
2018/0230360 A1 8/2018 Walker et al.
2018/0326679 A1 11/2018 Weisenberg et al.
2019/0049054 A1 2/2019 Gunnarsson et al.
2019/0071930 A1 * 3/2019 Hird ..... E21B 29/005
2019/0194519 A1 6/2019 Amanullah
2019/0257180 A1 8/2019 Kriesels et al.
2019/0323332 A1 10/2019 Cuellar et al.
2021/0172269 A1 6/2021 Li et al.
2021/0172270 A1 6/2021 Li et al.
2021/0172281 A1 6/2021 Li et al.
2021/0301605 A1 * 9/2021 Li ..... E21B 34/12

FOREIGN PATENT DOCUMENTS

CN 108240191 7/2018
EP 3034778 6/2016
GB 2155519 9/1985
GB 2357305 6/2001
GB 2466376 6/2010
GB 2484166 4/2012
WO 03/042494 5/2003
WO 2019027830 2/2019

OTHER PUBLICATIONS gryphonoilfield.com [online], "Gryphon Oilfield Services, Echo Dissolvable Fracturing Plug," available on or before Jun. 17, 2020, retrieved on Aug. 20, 2020, retrieved from URL <https://www.gryphonoilfield.com/wp-content/uploads/2018/09/Echo-Series-Dissolvable-Fracturing-Plugs-8-23-2018-1.pdf>, 1 page.

Takahashi et al., "Degradation study on materials for dissolvable frac plugs," URTeC 2901283, presented at the Unconventional Resources Technology Conference, Houston, Texas, Jul. 23-25, 2018, 9 pages.

tervesinc.com [online], TERVALLOY™ Degradable Magnesium Alloys, available on or before Jun. 12, 2016, via Internet Archive: Wayback Machine URL <https://web.archive.org/web/20160612114602/http://tervesinc.com/media/Terves_8-Pg_Brochure.pd>, retrieved on Aug. 20, 2020, <http://tervesinc.com/media/Terves_8-Pg_Brochure.pdf>. 8 pages.

PCT International Search Report and Written Opinion in International Appln. No. PCT/US2020/064206, dated Apr. 1, 2021, 14 pages.

PCT International Search Report and Written Opinion in International Appln. No. PCT/US2020/064210, dated Apr. 1, 2021, 15 pages.

PCT International Search Report and Written Opinion in International Appln. No. PCT/US2020/064213, dated Apr. 1, 2021, 14 pages.

edition.cnn.com [online], "Revolutionary gel is five times stronger than steel," retrieved from URL <https://edition.cnn.com/style/article/hydrogel-steel-japan/index.html>, retrieved on Apr. 2, 2020, available on or before Jul. 16, 2017, 6 pages.

Halliburton, "Drill Bits and Services Solutions Catalogs," retrieved from URL: <https://www.halliburton.com/content/dam/ps/public/

(56) References Cited

OTHER PUBLICATIONS sdbs/sdbs_contents/Books_and_Catalogs/web/DBS-Solution.pdf> on Sep. 26, 2019, Copyright 2014, 64 pages.
nature.com [online], "Mechanical Behavior of a Soft Hydrogel Reinforced with Three-Dimensional Printed Microfibre Scaffolds," retrieved from URL <https://www.nature.com/articles/s41598-018-19502-y>, retrieved on Apr. 2, 2020, available on or before Januaiy 19, 2018, 47 pages.
wikipedia.org [online], "Surface roughness," retrieved from URL <https://en.wikipedia.org/wiki/Surface_roughness> retrieved on Apr. 2, 2020, available on or before Oct. 2017, 6 pages.
Zhang et al, "Increasing Polypropylene High Temperature Stability by Blending Polypropylene-Bonded Hindered Phenol Antioxidant," Macromolecules, 51(5), pp. 1927-1936, 2018, 10 pages.
International Search Report and Written Opinion issued in International Application No. PCT/US2018/044095 dated Nov. 29, 2018, 14 pages.
GCC Examination Report issued in Gulf Cooperation Council Appln. No. 2020-41082, dated Jan. 10, 2022, 4 pages.
GCC Examination Report issued in Gulf Cooperation Council Appln. No. 2020-41084, dated Jan. 10, 2022, 4 pages.
U.S. Appl. No. 16/831,426, filed Mar. 26, 2020, Li et al.
U.S. Appl. No. 16/831,483, filed Mar. 26, 2020, Li et al.
U.S. Appl. No. 16/897,794, filed Jun. 10, 2020, Li et al.
U.S. Appl. No. 16/897,801, filed Jun. 10, 2020, Li et al.
U.S. Appl. No. 16/897,805, filed Jun. 10, 2020, Li et al.
PCT International Search Report and Written Opinion in International Appln. No. PCT/US2020/064195, dated Feb. 26, 2021, 14 pages.
PCT International Search Report and Written Opinion in International Appln. No. PCT/US2020/064215, dated Mar. 15, 2021, 13 pages.
PCT International Search Report and Written Opinion in International Appln. No. PCT/US2020/064220, dated Mar. 15, 2021, 15 pages.
GCC Examination Report issued in Gulf Cooperation Council Appln. No. 2020-41056, dated Dec. 6, 2021, 4 pages.
GCC Examination Report issued in Gulf Cooperation Council Appln. No. 2020-41086, dated Nov. 30, 2021, 4 pages.
PCT International Search Report and Written Opinion in International Appln. No. PCT/US2020/064198, dated Feb. 22, 2021, 13 pages.
PCT International Search Report and Written Opinion in International Appln. No. PCT/US2020/064203, dated Feb. 23, 2021, 14 pages.
PCT International Search Report and Written Opinion in International Appln. No. PCT/US2020/064219, dated Mar. 9, 2021, 13 pages.

* cited by examiner

DEPLOYING MATERIAL TO LIMIT LOSSES OF DRILLING FLUID IN A WELLBORE

FIELD

This specification relates to limiting lost circulation during drilling in subterranean formations.

BACKGROUND

Lost circulation is a major challenge in drilling operations. When drilling formations with natural or induced fractures, the drilling fluid can flow into these fractures rather than returning up the wellbore, causing a partial or total loss of drilling fluids. Lost circulation represents financial loss due to the non-productive time and extra cost on the drilling fluid to maintain the fluid level in the annulus. In severe lost circulation cases, the flowing of drilling fluid into the loss zone and resulted pressure drop on the open formation compromise the well control and can cause catastrophic results.

SUMMARY

This specification describes systems and methods to reduce or prevent the loss of drilling fluids into a subterranean formation. These systems and methods use a bottom hole assembly to deploy lost circulation fabric along wellbore walls in loss zones to limit the flow of drilling fluids into a subterranean formation. This approach uses differential pressure around the loss zone to set the lost circulation fabric, reducing the likelihood of formation damage by avoiding the use of additional forces on and interactions with the formation.

The lost circulation fabric can be rolled or compressed onto a spool assembly of the bottom hole assembly. This approach enables a short bottom hole assembly to deploy of a large area of fabric to seal a long section of loss zone. During the deployment, differential pressure around the loss zone is utilized to press the lost circulation fabric on the formation. The surface roughness of the lost circulation fabric can be enhanced provides sufficient friction for the lost circulation fabric to grasp on the formation and withstand the differential pressure. This design limits forces on and interactions with the formation applied by the barrier, reducing the possibility of the formation damage. Two types of actuation (ball type and solenoid type) mechanisms are designed to hydraulically drive a lock tube and release all the lock pins simultaneously. This invention represents a new approach of combating the severe lost circulation using lost circulation fabric with a compact bottom hole assembly and a reliable spiral spring release mechanism.

In one aspect, bottom hole assemblies with a combined roller-underreamer assembly include: a body configured to be attached to a drill pipe, the body having an uphole end and a downhole end; an uphole ring attached to the body; a downhole ring attached to the body between the uphole ring and the downhole end of the body; a sliding ring mounted around the body between the uphole ring and the downhole ring, the sliding ring attached to the downhole ring by at least one spring; a set tube slidably mounted around the body between the uphole ring and the sliding ring, the set tube having an uphole end and a downhole end; a reamer assembly with at least one first articulated arm with extending between the uphole ring and the downhole end of the set tube; and a roller assembly with: at least one second articulated arm extending between the uphole end of the set tube and the sliding ring; and a roller positioned at a joint of each second articulated arm.

In one aspect, bottom hole assemblies with a combined roller-underreamer assembly include: a body configured to be attached to a drill pipe; a first ring attached to the body; a second ring mechanically connected to the body, the second ring spaced apart from the first ring; a set tube slidably mounted around the body between the first ring and the second ring; a reamer assembly with at least one first articulated arm extending between the first ring and the set tube; and a roller assembly with: at least one second articulated arm extending between the set tube and the second ring; and a roller positioned at a joint of each second articulated arm.

In some embodiments, the set tube is moveable between a rolling position and a reaming position wherein the reaming position is between the rolling position and the uphole ring.

In some embodiments, each roller arm extends radially farther from the body than each reamer arm in the rolling position.

In some embodiments, bottom hole assemblies also include an actuator to move the set tube axially along the body. In some cases, the actuator is a mechanical actuator In some embodiments, each reamer arm comprises teeth for removing portions of the wellbore.

In some embodiments, the first articulated arms and the second articulated arms are positioned with an angular offset between the first articulated arms and the second articulated arms. In some cases, the reamer assembly has three first articulated arms with a 120 degree angular offset between the first articulated arms and the roller assembly has three second articulated arms with a 120 degree angular offset between the second articulated arms.

In some embodiments, bottom hole assemblies also include a third ring attached to the body with the second ring between the third ring and the set tube, the third ring attached to the second ring by at least one spring such that the second ring is slidably mounted around the body. In some cases, the set tube has a first end oriented towards the first ring and a second end oriented towards the second ring and each first articulated arm extends between the first ring and the second end of the set tube. In some cases, each second articulated arm extends between the first end of the set tube and the second ring.

In some embodiments, the set tube is moveable between a rolling position and a reaming position wherein the reaming position is between the rolling position and the first ring. In some cases, the roller arm extends radially farther from the body than the reamer arm in the rolling position. In some cases, bottom hole assemblies also include an actuator to move the set tube axially along the body. In some cases, the actuator is a mechanical actuator. In some cases, the reamer arm comprises teeth for removing portions of the wellbore. In some cases, the first articulated arms and the second articulated arms are positioned with an angular offset between the first articulated arms and the second articulated arms. In some cases, the reamer assembly has three first articulated arms with a 120 degree angular offset between the first articulated arms and the roller assembly has three second articulated arms with a 120 degree angular offset between the second articulated arms.

These systems and methods are capable of mitigating different degrees of lost circulation (that is, formations with different porosities and permeability) and are effective in handling loss zones with large fracture sizes. These systems and methods deploy lost circulation fabric along walls of a wellbore rather than pumping down fibrous, flaked or granular lost circulation materials (LCM) to seal the fractures in the loss zones.

This fabric-based approach can mitigate lost circulation in large-fracture-size loss zones (for example, where typical fracture sizes are greater than 5 millimeters (mm)). In contrast, the size of LCM is limited by the clearance of the bottom hole assembly and the integrity of the downhole tools. By using loss circulation fabric rather fibrous, flaked or granular LCM, the fabric-based approach reduces the likelihood of plugging a downhole bottom hole assembly by eliminating the use of the large-grain LCM used in severe lost circulation situations.

Mitigating large-fracture-size loss zones using LCM can require including a PBL sub as part of a bottom hole assembly to divert the LCM loaded fluids into the loss zone. Under extreme severe conditions, deploying LCM can require tripping the drilling bottom hole assembly out the hole, running and setting a drillable plug, applying a cement slurry or expensive thermoset plastic, and drilling-out the plug. The fabric-based approach lowers material costs and reduces non-productive time, which can be a significant operational cost, especially in high value wells such as offshore gas wells.

The systems described in this specification are relatively easy to deploy. Structurally, these systems are smaller and simpler than existing mechanical lost circulation mitigation methods that hydraulically or mechanically set expandable tubulars inside a wellbore. These systems include a spiral spring and associated lock pin(s) that act as an easy to deploy anchor for the lost circulation fabric. The spool assembly aligns and deploys the lost circulation fabric to cover an entire inner wall of the formation. In contrast, expandable tubular approaches use a specially designed bottom hole assembly to deploy a section of expandable metallic tubular to isolate the wellbore from the formation across the lost circulation zones. After the deployment, the tubular is permanently set on the formation and cemented with the casing. Using a mechanically or hydraulically driven expansion mechanism on the bottom hole assembly brings a degree of complexity as well as the risk to the operation associated the possibility of a failed expansion. The fabric-based approach avoids these issues as well as the potential drawback that the expandable tubular system adds extra stiffness to the drill pipe due to the tubular and internal expansion system which can be problematic, for example, in high dog-leg severity sections.

These systems can include an expandable roller/underreamer assembly that is compact and multifunctional. This approach allows circulation and rotation while running in the hole enabling deploying while drilling without the need for dedicated runs for underreaming and deployment.

Lost circulation fabrics include sheets of material whose structure and composition limit the flow of fluids, particularly drilling fluid, through the sheets. Examples of lost circulation fabrics include pliable membranes, meshes, and nets formed from a composite material, such as a fiber-reinforced polymer sheet. The material selected to form the lost circulation fabric includes physical properties selected to withstand downhole environments. The fabric may have a high elastic modulus, high tensile strength, high surface roughness, good toughness, and good thermal stability to withstand harsh downhole environments. Specifically, harsh downhole conditions can refer to high temperatures up to 250 degrees Celsius, high pressures up to 20,000 pounds per square inch (psi), the existence of multiphase media (such as coexisting fluid, gas, and solid media), shock and vibration, confinement, and loss of fluid circulation. To withstand these conditions, the tensile strength of the material of the lost circulation fabric can be between 10 and 10,000 megapascals (MPa), the toughness can be between 1 and 100 kilojoules per square meter (kJ/m$^2$), and the thermal stability can be greater than or equal to 100 degrees Celsius. Polymers, such as nylon, polycarbonate, polypropylene, and high-temperature polyethylene may be used to form a lost circulation fabric. High-temperature may refer to an ability of the material to retain its thermal stability in temperature ranges greater than the typical temperature range of commercially available types. For example, these polymers may be used to form a fiber-reinforced polymer used to make the lost circulation fabric. In other implementations, composites, such as carbon-reinforced polymers and glass fiber-reinforced polymers may be used to form lost circulation fabrics. In some cases, lost circulation fabrics are textiles made by weaving, knitting, or felting natural or synthetic fibers. In some cases, lost circulation fabrics are membranes, for example, extruded polymer sheets.

The details of one or more embodiments are set forth in the accompanying drawings and the description below. Other features, objects, and advantages will be apparent from the description and drawings, and from the claims.

DESCRIPTION OF DRAWINGS

FIGS. 9A, 9C, 9E, 9G and 9I are partial cross-sectional views of the positioning system and FIGS. 9B, 9D, 9F, 9H, and 9J are schematics show the position of a cam along a guide path during operation of the positioning system.

FIGS. 11A-18C illustrate operation of the bottom hole assembly. FIGS. 11A, 12A, 13A, 14A, 15A, 16A, 17A, and 18A are schematic side views of a bottom hole assembly in a wellbore. FIGS. 11C, 12C, 13C, 14C, 15C, 16C, 17C, and 18C are schematic plan views of the spool ring 140 of the bottom hole assembly.

Like reference symbols in the various drawings indicate like elements.

DETAILED DESCRIPTION

This specification describes a bottom hole assembly for deploying a lost circulation fabric in a wellbore to reduce or prevent lost circulation. The lost circulation fabric can be a high strength membrane or mesh that is deployed to cover portions of a loss zone in a wellbore that experience lost circulation due to, for example, highly fractured formations. The lost circulation fabric prevents drilling fluid from escaping into the formation from the wellbore by acting as a barrier (for example, an impermeable membrane) between the wellbore and the formation. The bottom hole assembly includes a spring ring, a spool ring, and a underreamer to transport, deploy, and press the lost circulation fabric to walls of the wellbore. Deploying the lost circulation fabric in the wellbore at large loss zone of the formation reduces lost circulation fluid while also reducing the risk of formation damage.

Figure 1:
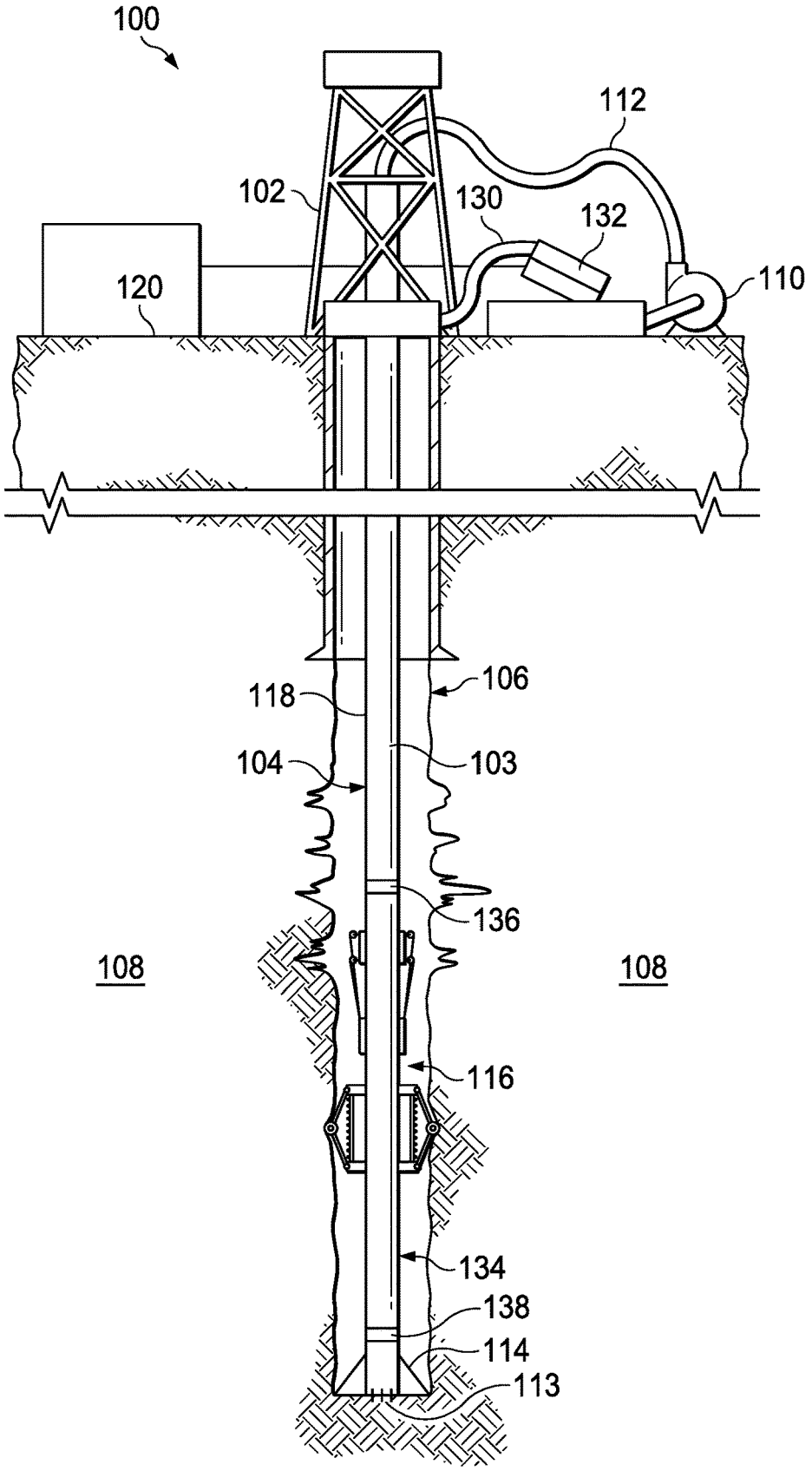
FIG. 1 is a schematic of a drilling system that includes a rig and a drill string supported by the rig.

FIG. 1 shows a view of a drilling system 100 that includes a rig 102 and a drill string 104 supported by the rig 102. The drill string 104 extending into a subterranean formation 108 is being used to form a wellbore 106. A fluid pump 110 pumps drilling fluid to the drill string 104 via a drill fluid line 112. The drilling fluid flows downhole, though the drill string 104, and out an outlet 113 of a drill bit 114 that is part of a bottom hole assembly 116. Drilling fluid exiting the outlet 113 mixes with cuttings detached from the formation 108 by the drill bit 114. The drilling fluid carries cuttings uphole towards the surface 120 through an annular space 118 between the drill string 104 and the walls of the wellbore 106. The drilling fluid and cuttings flow out of the formation 108, though a fluid line 130, and into a container 132 for treatment, or transportation to a treatment facility.

The drill string 104 includes a drill pipe 103 supporting the bottom hole assembly 116 which includes the drill bit 114. The bottom hole assembly 116 includes a body 134 with an uphole attachment end 136 opposite the drill bit 114. In the drilling system 100, the uphole attachment end 136 of the bottom hole assembly 116 is attached to the drill pipe 103 of the drill string 104. The uphole attachment end 136 has threaded portions that engage with complimentary threads on the drill pipe 103. In some systems, the attachment ends use a locking bar, magnets, bolts, tongue and groove assemblies, or any combination thereof, to attach the ends of the body to the drill pipe and drill bit 114.

Figure 2:
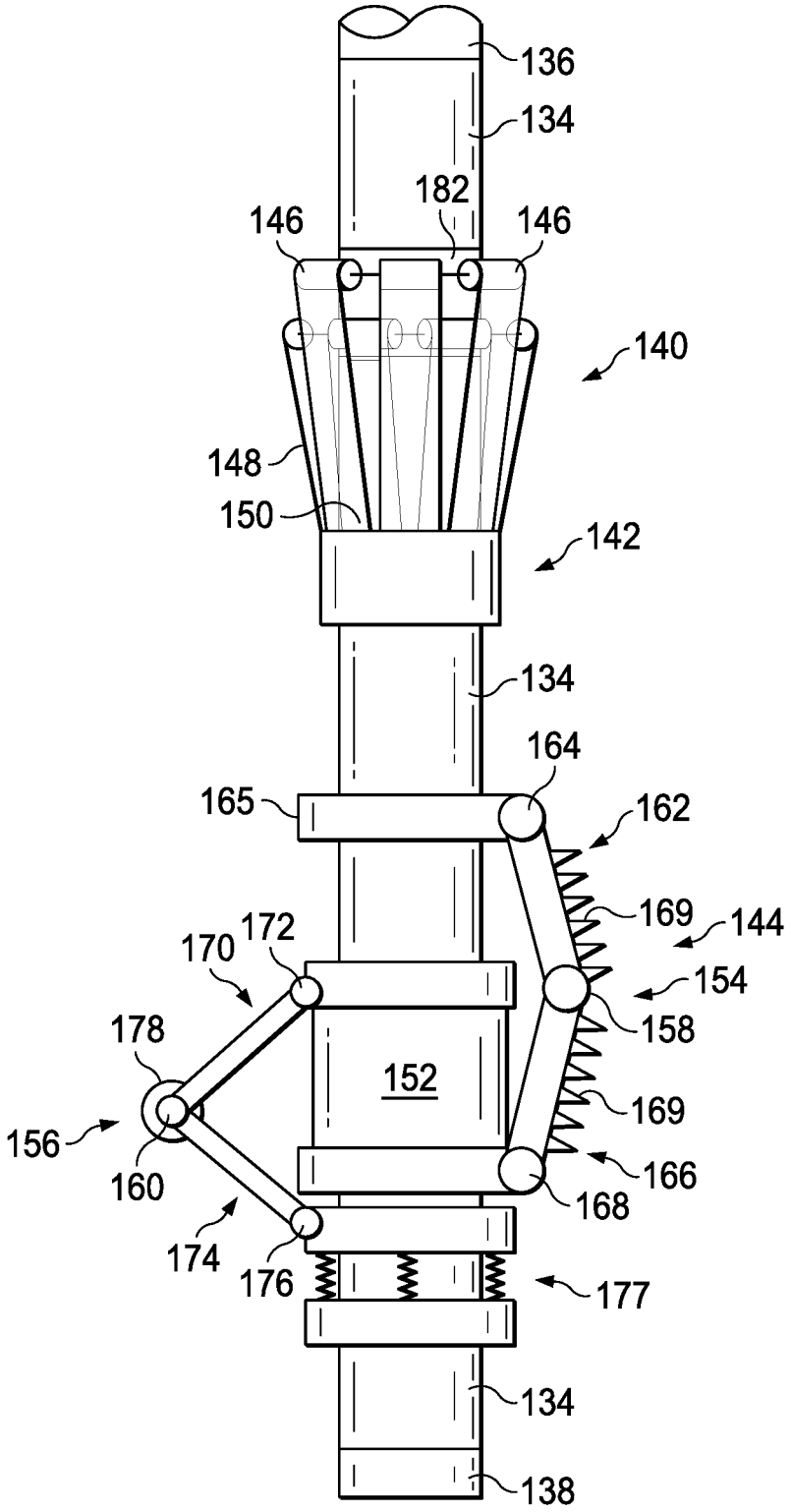
FIG. 2 is a side view of the bottom hole assembly of FIG. 1.

FIG. 2 shows a side view of the bottom hole assembly 116. The bottom hole assembly 116 includes a spool ring 140, a spring ring 142, and a combined roller-underreamer assembly 144, each attached to the body 134. The spool ring 140 has a plurality of spools 146 on which a rolled, compressed, or coiled lost circulation fabric 148 is releasably mounted. FIG. 2 shows the lost circulation fabric 148 in an initial, or undeployed, position. Each roll of lost circulation fabric 148 is mounted on one of the plurality of spools 146 and attached to the spring ring 124 at a first end 150 of the lost circulation fabric 148.

The spring ring 142 is disposed around the body 134, downhole of the spool ring 140. The spring ring 142 is shown in a compressed position, attached to the body 134. When released, the spring ring 142 expands radially outward from the body 134. The structure and operation of the spool ring 140 and the spring ring 142 are described in more detail with reference to FIGS. 3A-5B.

The combined roller-underreamer assembly 144 is attached to the body 134, downhole of both the spool ring 140 and the spring ring 142. When used to describe the relative positions of components of the bottom hole assembly on the body 134, the term "uphole" is used to indicate closer to the uphole attachment end and "downhole" is used to indicate closer to the end of the body where the drill bit 114 is attached. These terms indicate position of components on the body/bottom hole assembly whether the bottom hole assembly is in a wellbore or at the surface.

The combined roller-underreamer assembly 144 includes an uphole attachment point 164 and a downhole attachment point 176 spaced apart from the uphole attachment point 164. In the illustrated system, the uphole attachment point 164 is a hinge mounted on a first ring 165 attached to and fixed in position relative to the body 134 and the downhole attachment point 176 is a hinge mounted on a second ring 177 attached to and fixed in position relative to the body 134. Some systems use other mechanisms for the attachment points.

The combined roller-underreamer assembly 144 also includes a set tube 152, a reamer assembly 145, and a roller assembly 147. The set tube 152 is slidably mounted around the body 134 between the first ring 165 and the second ring 177. The reamer assembly 145 includes at least one first articulated arm (that is, a reamer arm 154) extending between the first ring 165 and the set tube 152. Similarly, the roller assembly 147 includes at least one second articulated arm (that is, a roller arm 156) extending between the set tube 152 and the second ring 177. The roller assembly 147 also includes a roller 178 positioned at a joint of each roller arm 156. The reamer arm 154 bends at a central hinge 158. The roller arm 156 also bends at a central hinge 160.

The set tube 152 is moveable between a rolling position and a reaming position wherein the reaming position is between the rolling position and the first ring 165. When the set tube 152 is in the rolling position, the central hinge 160 of the roller arm 156 extends radially farther from the body 134 than the central hinge 158 of the reamer arm 154. When the set tube 152 is in the reaming position, the central hinge 158 of the reamer arm 154 extends radially farther from the body 134 than the central hinge 160 of the roller arm 156. The structure and operation of the combined roller-underreamer assembly 144 is described in more detail with reference to FIGS. 7A-8B.

Figure 3A:
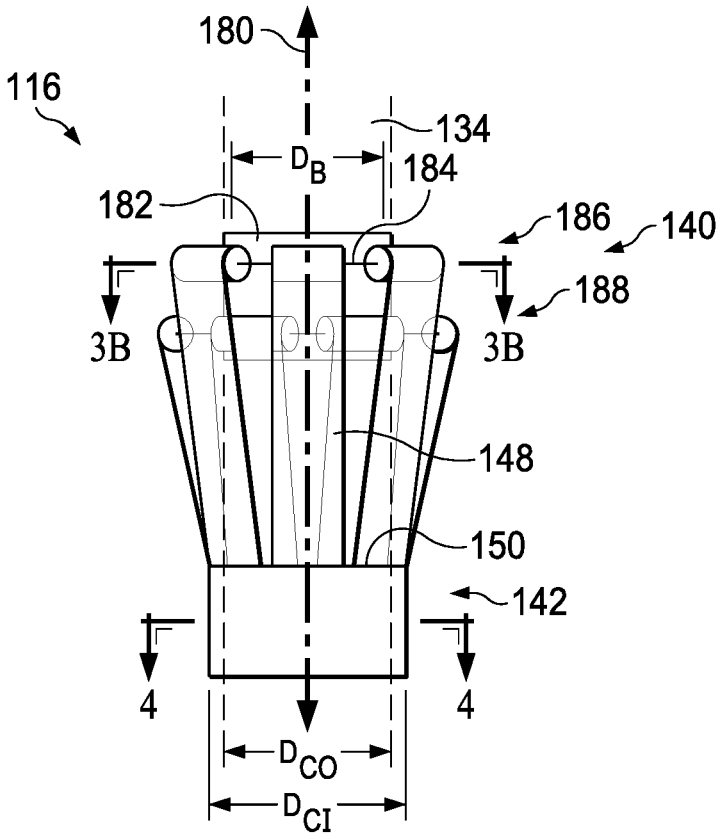
FIGS. 3A and 3B are, respectively, a side view and a cross-sectional view of a spool ring mounted on a body of the bottom hole assembly.
Figure 3B:
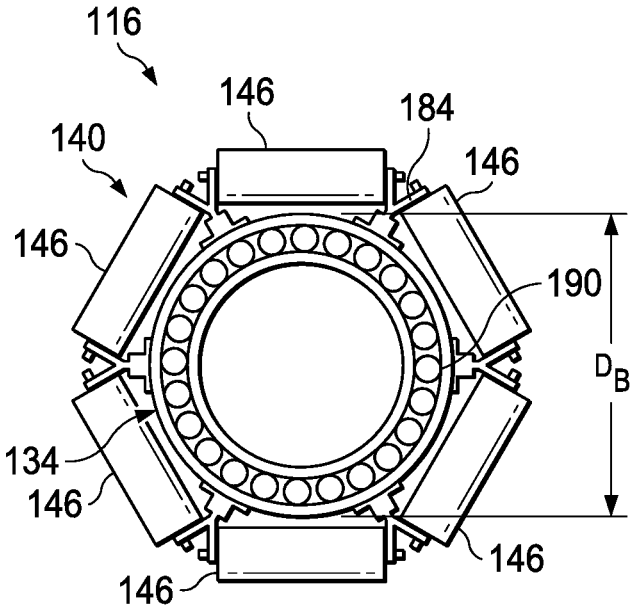

FIG. 3A is a side view of the spool ring 140, the spring ring 142, and lost circulation fabric 148 mounted on the spools 146 before deployment. FIG. 3B is a cross section of the spool ring 140 mounted on the body 134, and the lost circulation fabric 148 mounted on the spools 146. In the bottom hole assembly 116, the spool ring 140 is disposed an outer surface of the body 134.

The spool ring 140 includes a base 182 and arms 184 extending radially outward from the base 182. The base 182 is mounted on the body 134 with the arms 184 holding the spools 146 away from the base 182 so the spools 146 can rotate during deployment of the lost circulation fabric 148. Some spool rings do not have a base. In these spool rings, the arms 184 are directly attached to extend outward from the body 134 rather than having a base interposed between the arms 184 and the body 134.

The spools 146 includes a first set of spools 146 and a second set of spools 146 offset from the first set of spools 146 towards a downhole end of the body 134. The second set of spools 146 is positioned with an angular offset from the first set of spools 146 such that rolls of the lost circulation fabric 148 mounted on the first set of spools 146 overlap rolls of the lost circulation fabric 148 mounted on the second set of spools 146. The spool ring 140 has six spools 146 in each set of spools 146. Some spool rings have fewer or more spools 146 in each set.

In FIGS. 3A and 3B, the spring ring 142 is in its compressed position and has a compressed inner diameter $D_{CI}$ and a compressed outer diameter $D_{CO}$. The compressed inner diameter $D_{CI}$ is defined by an inner surface 190 of the spring ring 142. The compressed outer diameter is defined by an outer surface 192 of the spring ring. The compressed inner diameter $D_{CI}$ is equal to or slightly larger than an outer diameter $D_B$ of the body 134, defined by an outer surface 194 of the body 134. The inner surface 190 of the spring ring 142 abuts the outer surface 194 of the body 134 in the compressed position.

Figure 4:
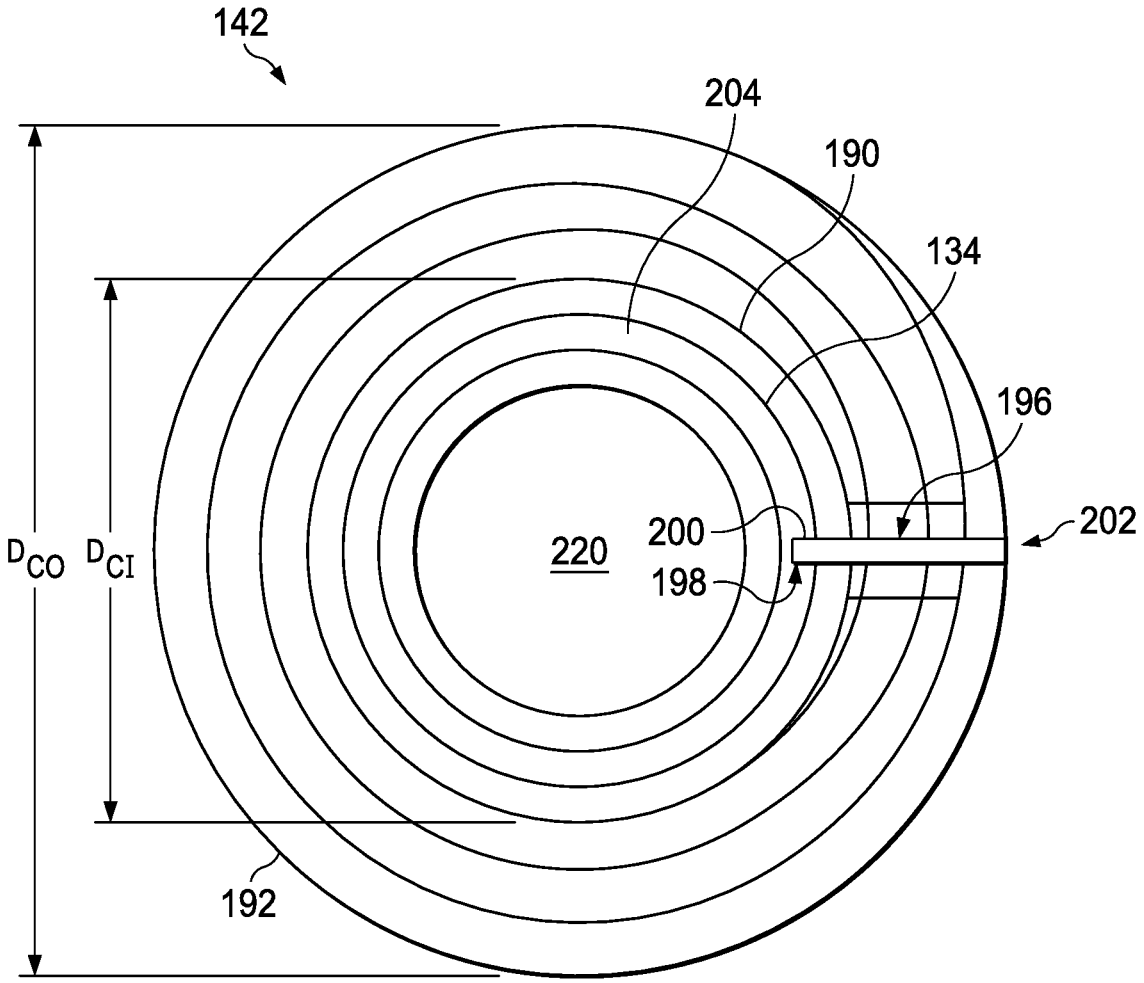
FIG. 4 is a cross-sectional view of a spring ring.

FIG. 4 is a cross-sectional view of the spring ring 142. The spring ring 142 is a coiled spring that expands radially outward from the body 134 towards the walls of the wellbore 106 when the spring ring 142 is released. The spring ring 142 is held in its compressed position by a locking pin 196 with an engagement surface 198 at a first end 200. A second end 202 of the locking pin 196 is attached to the outer surface 192 of the spring ring 142. A locking member 204 with a complimentary locking surface 206 is arranged within the body 134. The engagement surface 198 of the locking pin 196 engages the complimentary locking surface 206 of the locking member 204 to hold the locking pin 196 with the locking member 204. Axial movement of the locking member 204 disengages the engagement surface 198 of the locking pin 196 from the complimentary locking surface 206 of the locking member 204. This disengagement releases the spring ring 142 from its compressed position. With no force holding the spring ring 142 in its compressed position, the spring ring 142 expands radially outward from the body 134.

Figure 5A:
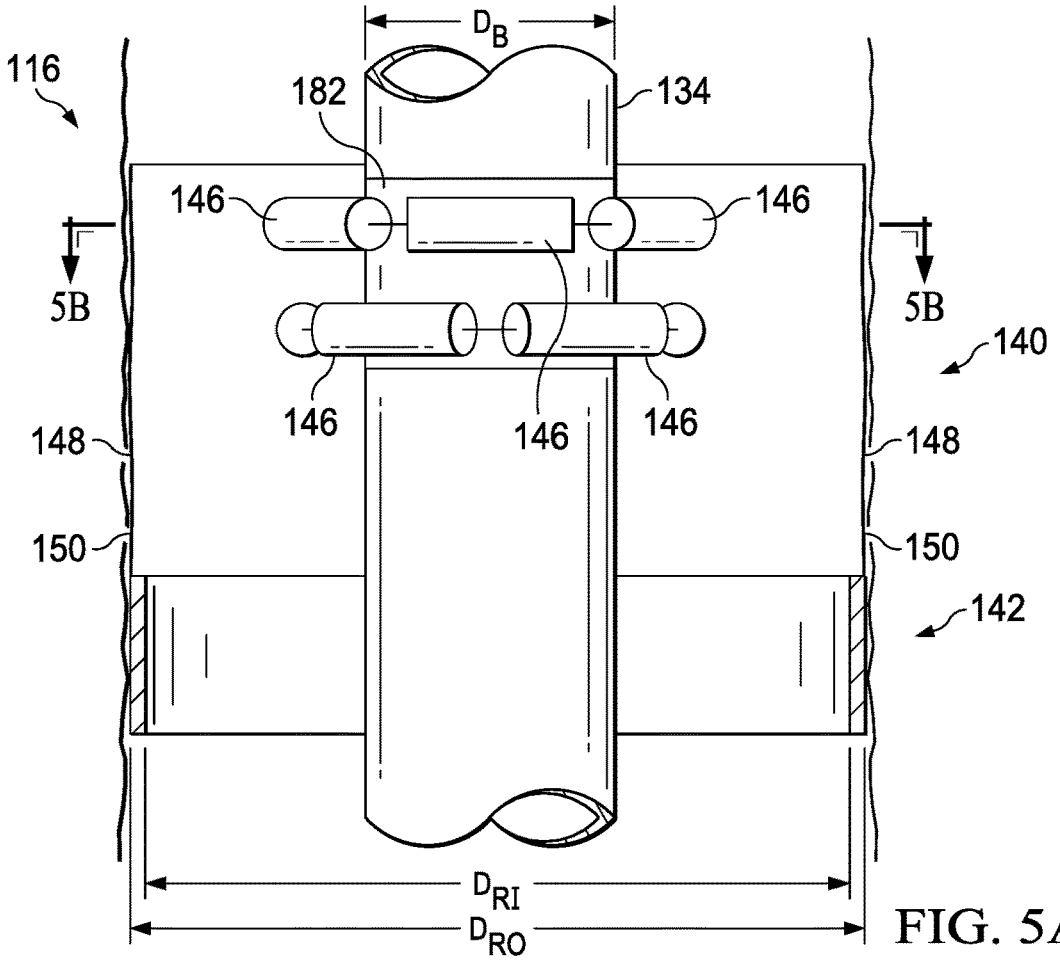
FIGS. 5A and 5B are, respectively, a side view and a top view of the spool ring mounted on the body, the relaxed spring ring, and the lost circulation fabric deployed covering walls of the wellbore.
Figure 5B:
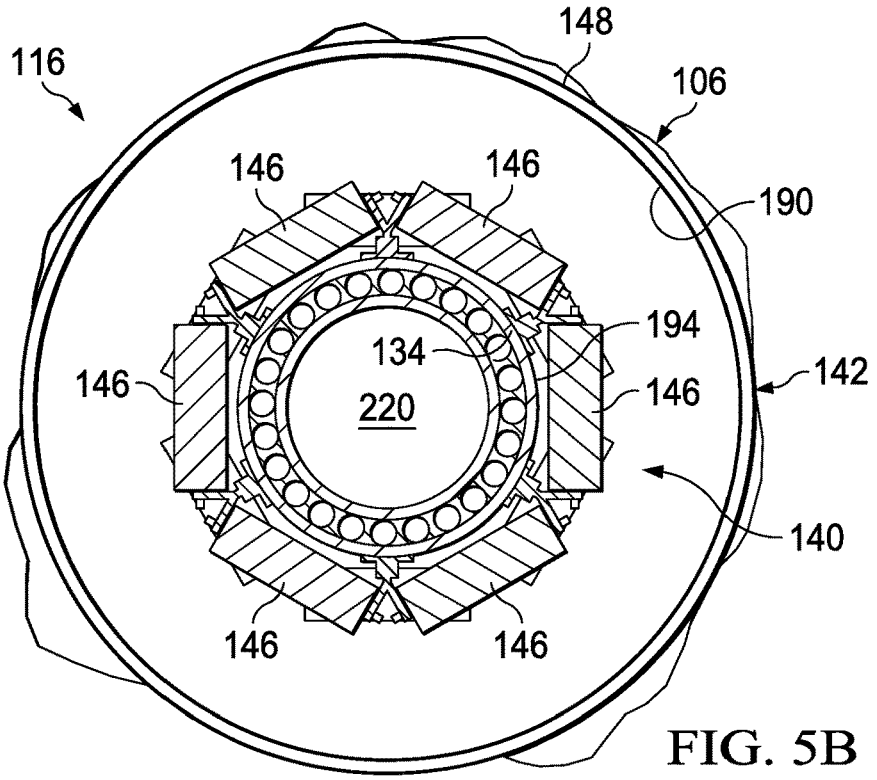

FIG. 5A is a side view of the spool ring 140, the relaxed spring ring 142, and deployed lost circulation fabric 148. FIG. 5B is a top view of the spool ring 140 mounted on the body 134, the relaxed spring ring 142, and the lost circulation fabric 148 deployed covering walls of the wellbore 106. The lost circulation fabric 148 has been released from the spools 146 to attach to walls of the wellbore 106, however, the first end 150 of the lost circulation fabric 148 remains attached to the spring ring 142. The spring ring 142 is in the relaxed position and has a relaxed inner diameter $D_{RI}$ and a relaxed outer diameter $D_{RO}$, defined by the inner surface 190 of the spring ring 142 and the outer surface 192 of the spring ring 142, respectively. In the relaxed position, the inner surface 190 of the spring ring 142 is spaced apart from the outer surface 194 of the body 134 and at least part of the outer surface 192 of the spring ring 142 abuts the walls of the wellbore 106.

Figure 6A:
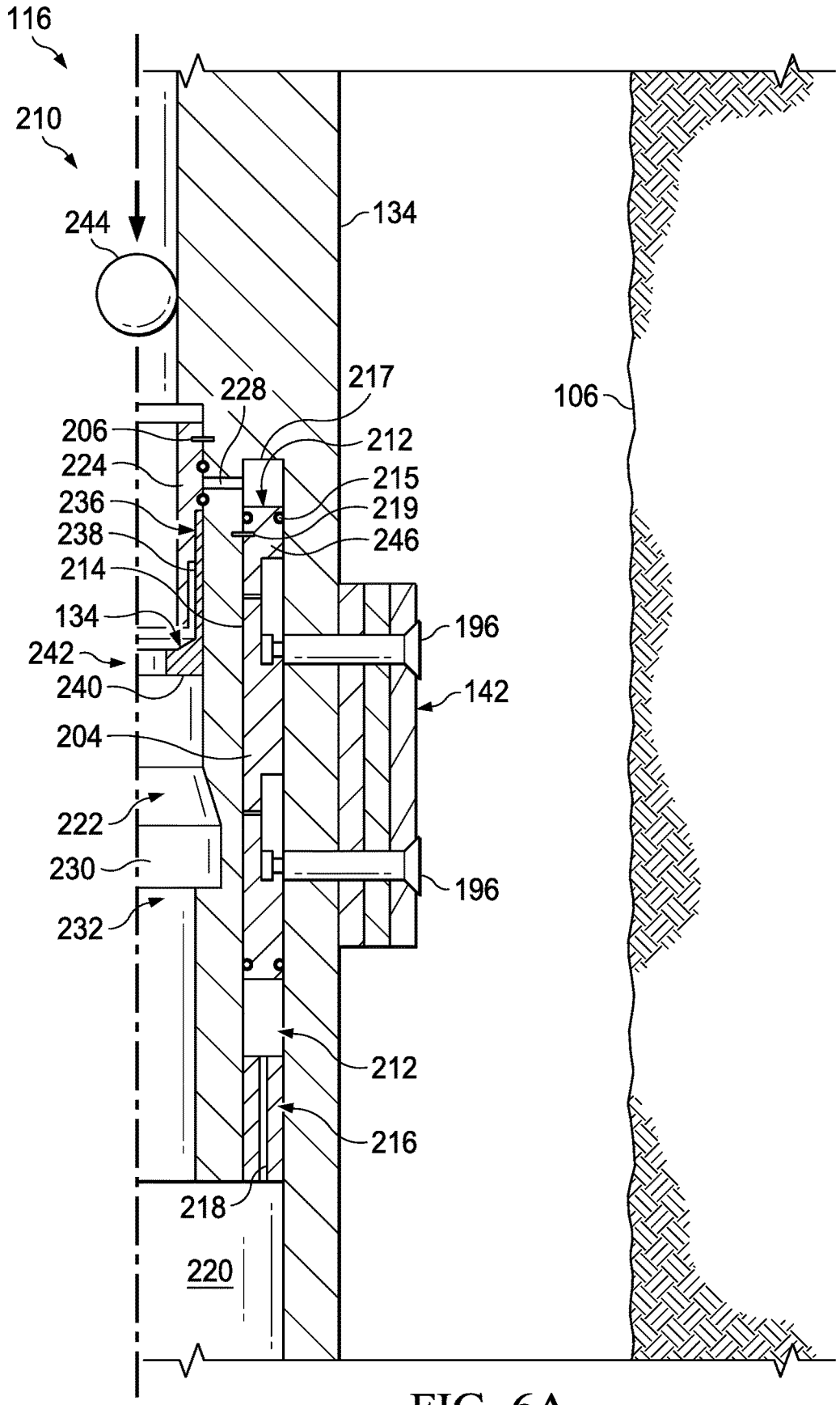
FIG. 6A-6C are cross-sectional views showing a spring release for mechanically releasing a spring ring.
Figure 6B:
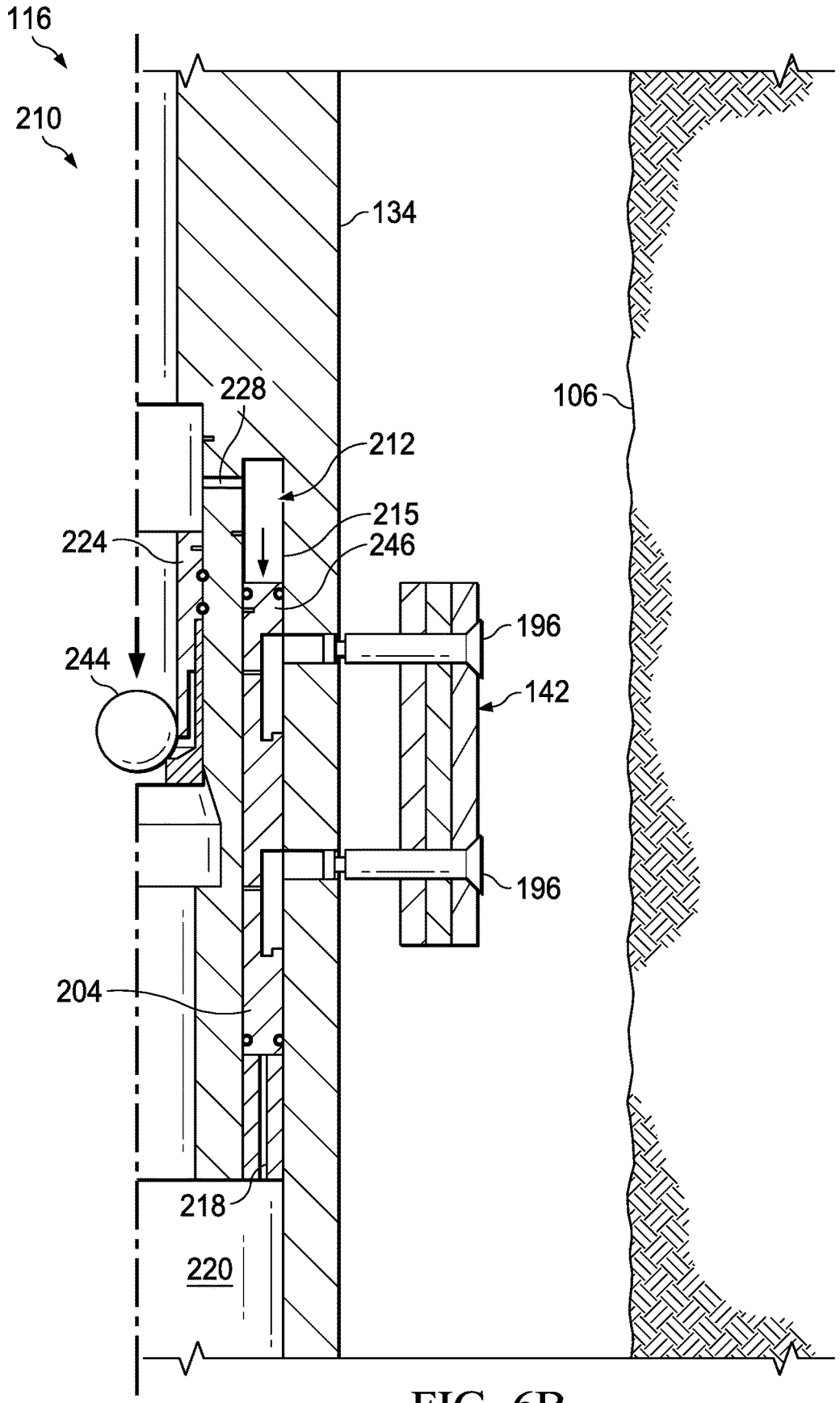
Figure 6C:
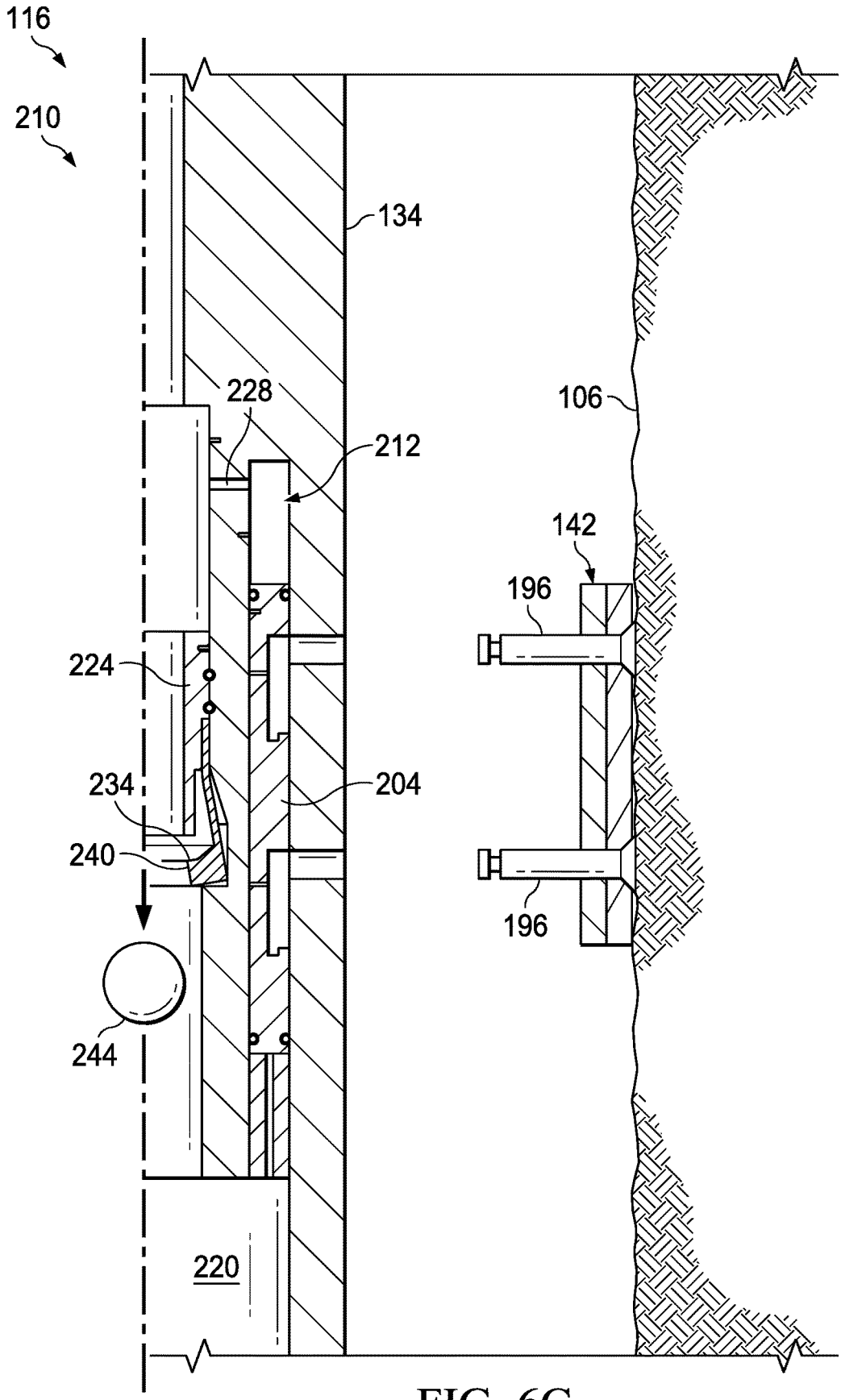

FIG. 6A-6C are cross-sectional views showing a spring release 210 for mechanically releasing the spring ring 142. The spring release 210 includes an internal compartment 212 defined by sidewalls 214, 215, 217 of the body 134 and the locking member 204 slidably disposed in the internal compartment 212. The locking member 204 can move axially in the internal compartment 212 from an initial position engaging the lock pin 196 to an actuated position disengaged from the lock pin 196 in. A shearing pin 219 holds the locking tube in the initial position. A vent block 216 defines an opening 218 fluidly connecting the internal compartment 212 to an interior cavity 220 of the body 134. Air flows through the opening 218 when the locking member 204 moves axially within the internal compartment 212 to equalize the pressure between the internal compartment 212 and the interior cavity 220 of the body 134.

The body 134 has a recess 222 on the sidewall 214 facing the interior cavity 220 of the body 134. A control member (for example, control tube 224) is slidably mounted to the recess 222. A shearing pin 226 attached to the control tube 224 and the sidewall 214 constrains the control tube 224 in an initial axial position in the recess 222, as shown in FIG. 6A. In the initial position the control tube 224 covers a channel 228 (fluid port) that fluidly connects the internal compartment 212 to the recess 222 and the interior cavity 220 of the body 134. The recess 222 has a notch 230 arranged at a downhole end 232 that extends farther into the sidewall 214 of the body 134 relative to the recess 222.

An actuator 234 is fixed to the control tube 224 at an uphole end 236. The actuator 234 has a stem 238 and a finger 240 that protrudes radially into the interior cavity 220 of the body 134. The finger 240 attaches to the stem 238 at a downhole end 242 of the actuator 234. Together the stem 238 and the finger 240 form an "L" shape. Some actuation members are collet fingers.

To release the spring ring 142 from the compressed position to the relaxed position, the actuator 234 is engaged. For example, a ball 244 can be used to operate the actuator 234. The ball 244 is inserted into the drilling fluid line 112 so that the ball 244 flows through the drill pipe 103 into the body 134 and out the drill bit 114. In some actuation mechanisms, multiple balls are inserted into the drill fluid line 112.

In the initial (compressed) position, the spring release 210 is as shown in FIG. 6A. The spring ring 142 is axially and rotatably constrained to the body 134 of the bottom hole assembly 116 in the compressed position. To release the spring ring 142, the ball 244 is inserted into the drilling fluid line 112 and moves downhole with the flow of drilling fluid. The ball moves through the drill string 104 and into the interior cavity 220 of the body 134. The interior cavity 220 of the body 134 is fluidly connected to an interior of the drill pipe 103 that defines the fluid path of the drilling fluid. The ball 244 engages with the finger 240 of the actuator 234 and translates the actuator 234 and the control tube 224 axially on the sidewall 214. The force of the ball 244 moving downhole breaks the shearing pin 226, moving the control tube 224 and actuator 234 from the initial position to an intermediate position.

The intermediate position is shown in FIG. 6B. In the intermediate position of the spring release 210, the channel 228 is exposed, fluidly connecting the interior cavity 220 of the body 134 with the internal compartment 212. Drilling fluid flows through the channel 228, into the internal compartment 212, and applies a force to an uphole section 246 of the locking member 204. The pressure increases and applies sufficient force to overcome the static frictional force between the locking tube and the sidewalls 214, 215 of the internal compartment 212. Typically, a momentary decrease of the flow rate is observed when the control ball blocks the flow path on the control tube before it slides down and releases the ball. The locking member 204 moves axially within the internal compartment 212 and disengages the lock pins 196. Air or fluid is pressed out of the internal compartment 212 by the movement of the locking member 204, through the opening 218 of the vent block 216. In this configuration, the spring ring 142 is released and begins to expand radially, as shown in FIG. 6B.

The relaxed position of the spring release 210 is shown in FIG. 6C. The spring ring 142 abuts the walls of the wellbore 106 while still permanently attached to the first end 150 of the lost circulation fabric 148. The locking member 204 abuts the vent block 216 and remains static. The control tube 224 and actuator 234 continue to move axially with the ball 244 until the finger 240 aligns with the notch 230 of the recess 222. The actuator 234 is made of a resilient material. When the actuation member aligned with the notch 230, the force of the ball 244 presses the finger 240, and part of the stem 238, into the notch 230. The actuator 234 resiliently bends to disengage from the ball 244. The ball 244 then continues to flow with the drilling fluid, exits the drill bit 114, and returns to the surface with the drilling fluid. In some spring release mechanism, the actuation member is made of a metal or plastic that permanently deforms in the relaxed position of the spring release mechanism.

Figure 7A:
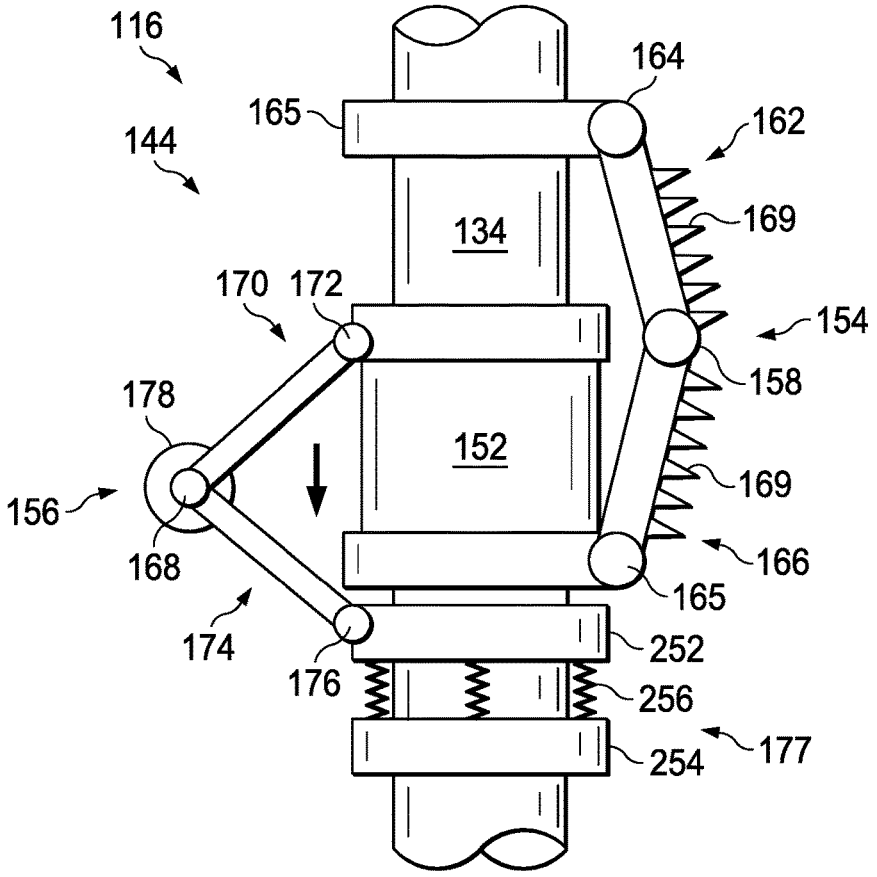
FIGS. 7A and 7B are, respectively, a side view and a schematic top view of a combined roller-underreamer assembly in the rolling position.
Figure 7B:
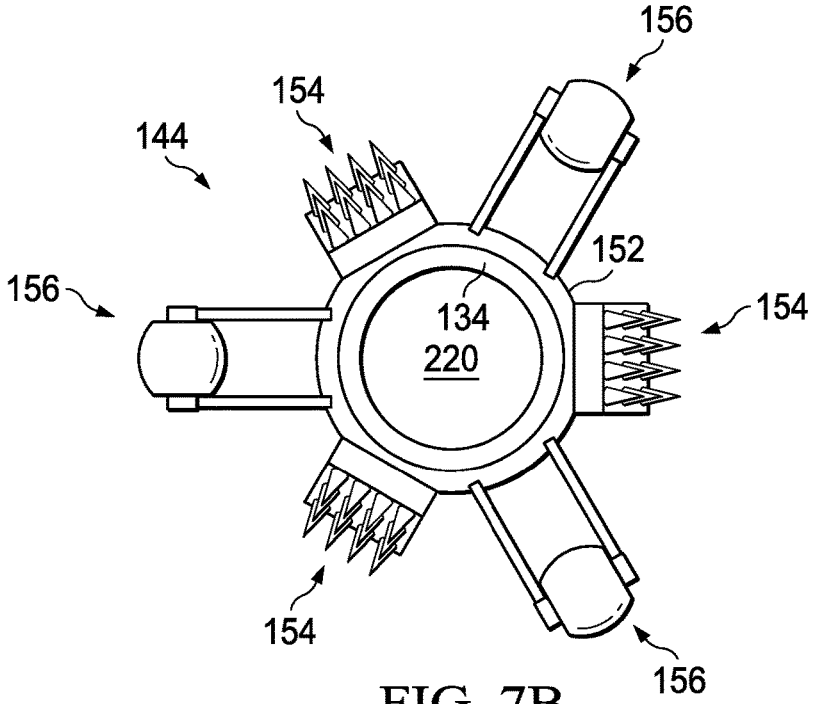
Figure 8A:
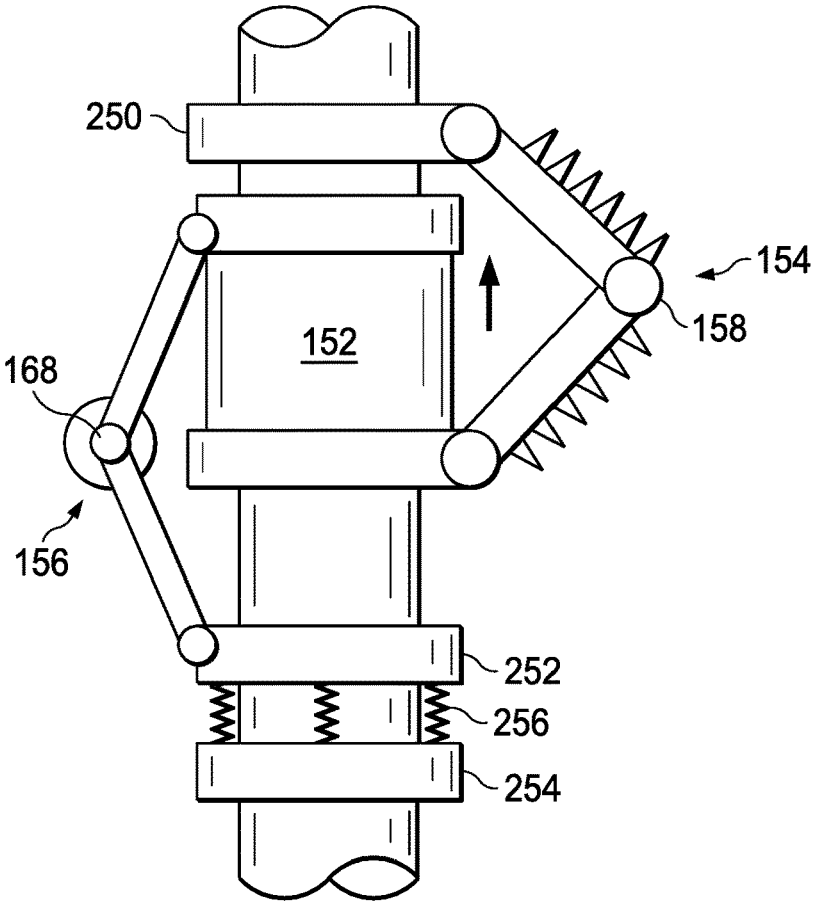
FIGS. 8A and 8B are, respectively, a side view and a schematic top view of a combined roller-underreamer assembly in the reaming position.
Figure 8B:
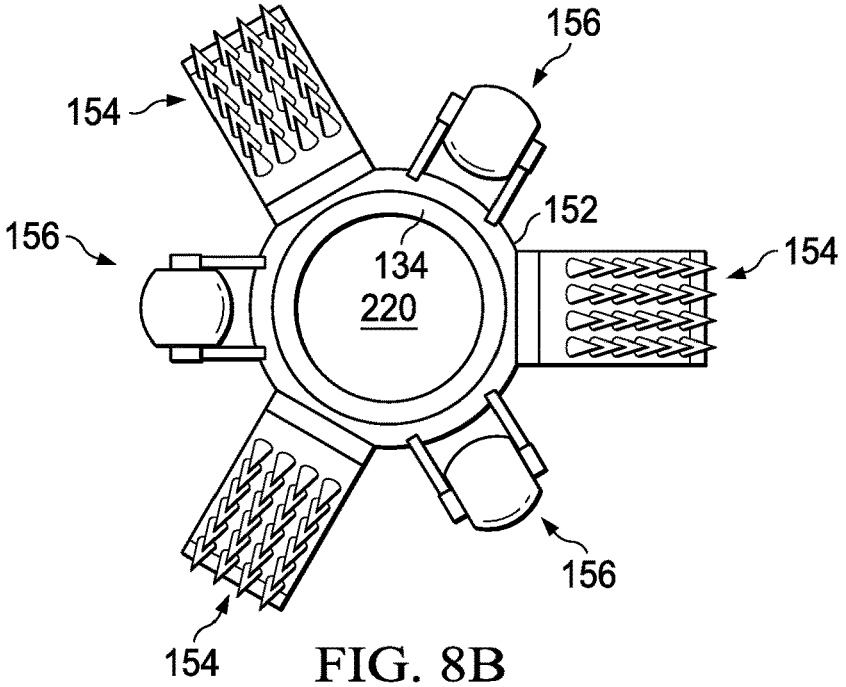

FIGS. 7A and 7B shows the combined roller-underreamer assembly 144 in the rolling position. FIGS. 8A and 8B show the combined roller-underreamer assembly 144 in the reaming position. As described with respect to FIG. 2, the set tube 152 is moveable between a rolling position and a reaming position wherein the reaming position is between the rolling position and the first ring 165. When the set tube 152 is in the rolling position, the central hinge 160 of the roller arm 156 extends radially farther from the body 134 than the central hinge 158 of the reamer arm 154. When the set tube 152 is in the reaming position, the central hinge 158 of the reamer arm 154 extends radially farther from the body 134 than the central hinge 160 of the roller arm 156.

The second ring 177 include an uphole portion 252 attached to a downhole portion 254 by springs 256. The hinge 176 is attached to the uphole portion 252 of the second ring 177 that is mounted to the body 134. The uphole portion 252 of the second ring 177 is axially movable relative to the downhole portion 254 of the second ring 177. The downhole portion 254 of the second ring 177 fixes the position the second ring relative to the body 134 of the bottom hole assembly. The springs 256 compensate to some extent for variations the dimensions of the wellbore when the combined roller-underreamer assembly 144 is in rolling position. For example, movement of the combined roller-underreamer assembly 144 through a narrower portion of a wellbore will push the rollers 178 radially inward and compress the springs 256 by pushing the uphole portion 252 of the second ring 177 towards the downhole portion 254 of the second ring 177. When the wellbore widens, the springs 256 bias the uphole portion 252 of the second ring 177 away the downhole portion 254 of the second ring 177 helping move the rollers 178 radially outward to help maintain contact with walls of the wellbore. The first ring 165 is arranged uphole of the set tube 152. The uphole portion 252 of the second ring 177 is arranged downhole of the set tube 152.

FIGS. 9A, 9C, 9E, 9G and 9I are partial cross-sectional views of a positioning system 260 that controls the position of the set tube 152 relative to the body 134. The positioning system includes a cam 282 engaged with a guide path 284. FIGS. 9B, 9D, 9F, 9H, and 9J show the position of the cam 282 along the guide path 284 during operation of the positioning system 260. The positioning system 260 and the spring release mechanism are controlled by balls with different diameters. The mechanism controlled by small balls is located in the lower part of the bottom hole assembly so that small balls do not activate the upper mechanism, and larger balls which control the upper mechanism get caught by a collection basket before they reach the lower mechanism.

The positioning system 260 includes a control element (for example control tube 286). Movement of the control tube 286 relative to the body 134 controls the position of the set tube 152 relative to the body 134. In the positioning system 260, the cam 282 projects radially outward from the control tube and the guide path 284 is a groove defined in a surface of a sidewall 264 of the body 134. In some positioning systems, the guide path is defined in an outer surface of the control tube and the cam projects radially inward from the sidewall 264.

A finger 288 is attached to a downhole end of the control tube 286 extending radially into the interior cavity 220 of the body 134. In the positioning system 260, the finger 288 and control tube 286 are separate components. In some positioning mechanism, the finger and the tube element are formed as a single component. The control tube 286 and the finger 288 are attached such movement of the finger 288 also moves the control tube 286. Due to the interaction between the cam 282 and the guide path 284, axial movement of the finger 288 and the control tube 286 rotates the control tube.

The positioning system 260 includes a first interior chamber 262 defined by sidewalls 264, 266, 268 of the body 134. An uphole end 270 of the set tube 152 extends into the first interior chamber 262. The sidewalls 264, 266, 268 of the body 134 and the uphole end 270 of the set tube 152 define a pressure chamber 272. The pressure chamber 272 fluctuates in volume as the set tube 152 moves axially between the reaming position and the rolling position.

Figure 9A:
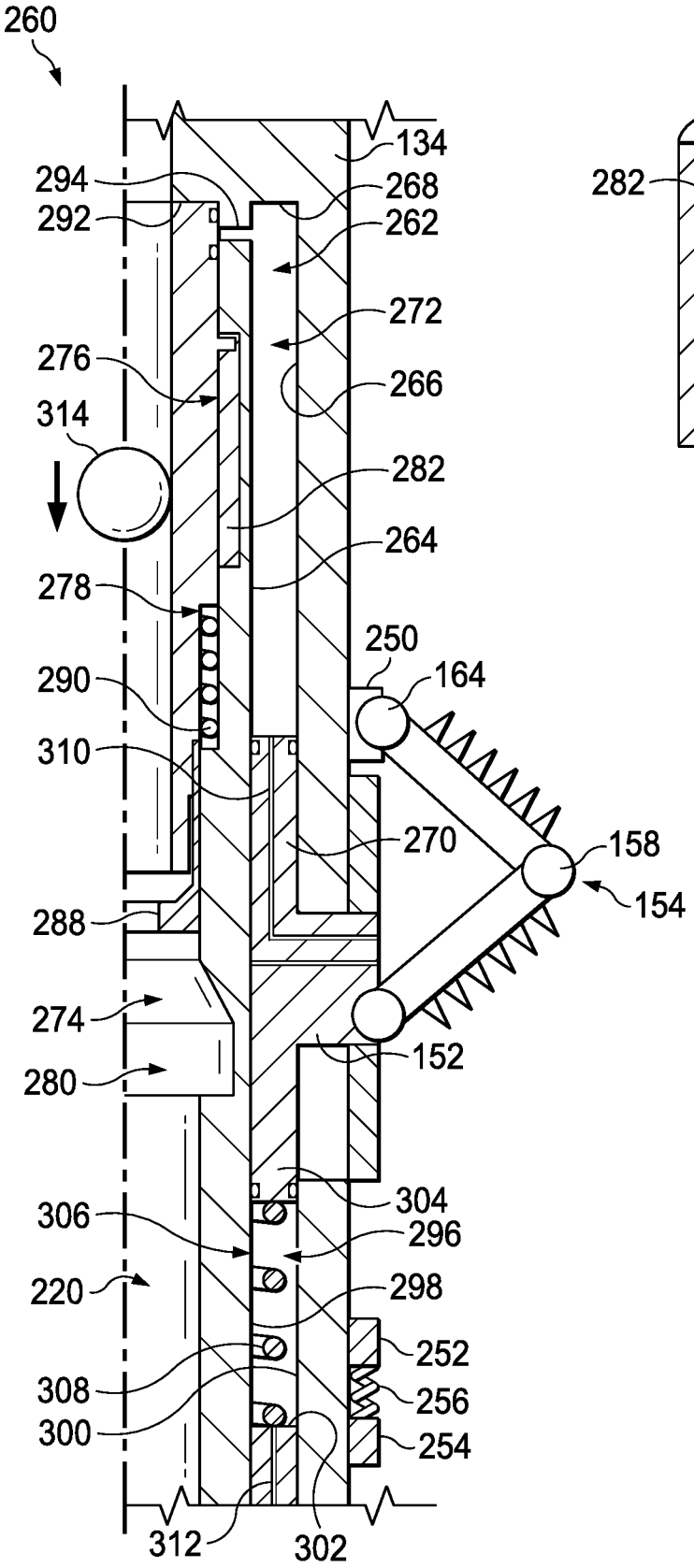
FIGS. 9A-9J illustrate a positioning system that controls the position of the set tube relative to the body of the bottom hole assembly.

The sidewall 264 defines a recess 274 that includes a first notch 278 and a second notch 280 on a surface of the sidewall 264 facing the interior cavity 220. A first spring 290 is arranged in the first notch 278 between the control tube 286 and the sidewall 264. The first spring 290 biases the control tube 286 towards an uphole end of bottom hole assembly. In the absence of other forces, the first spring 290 pushes the control tube 286 to abut an uphole boundary 292 of the recess 274, as shown in FIG. 9A. In this configuration, a fluid port 294 (channel) is covered. When exposed, the fluid port 294 connects the first interior chamber 262 of the positioning system 260 to the interior cavity 220 of the body 134, as described in more detail with reference to FIGS. 9C, 9E, and 9G.

A second interior chamber 296 is defined by sidewalls 298, 300 of the body 134 and a chamber-isolating ring 302. A downhole end 304 of the set tube 152 extends into the second interior chamber 296. A second spring 308 is arranged in the second interior chamber 296 and biases the set tube in the reaming position (shown in FIGS. 9A and 9I).

As the set tube 152 moves its reaming position to its rolling position, the volume of the pressure chamber 272 increases and the volume of the second interior chamber 296 decreases. As the set tube 152 moves from its rolling position to its reaming position, the volume of the pressure chamber 272 decreases and the volume of the second interior chamber 296 increases. The uphole end 270 of the set tube 152 has a first equalizing port 310 that fluidly connects the pressure chamber 272 with the annular space between the body 134 and the wellbore 106. The first equalizing port 310 allows fluid to gradually escape the pressure chamber 272. The chamber-isolating ring 302 has a second equalizing port 312 that fluidly connects the second interior chamber 296 with the annular space between the body 134 and the wellbore 106. The second equalizing port 312 allows pressure in the second interior chamber 296 to match pressure in the annulus between bottom hole assembly and walls of the wellbore.

FIGS. 9B, 9D, 9F, 9H, and 9J show the cam 282 engaged with the guide path 284 in various positions. The guide path 284 includes a pattern 285 that has a series of five positions: position A, position B (second position), position C (third position), position D (fourth position), and position E (fifth position). Position A and Position E are closed positions (that is, the control tube blocks inlet port). Position B and Position D are release positions (that is, the finger attached to control flexes to release an actuator ball). Position C is an open position (that is, the control tube is not blocking the inlet port). The guide path 284 is a continuous path that extends around the inner wall of the body 134 or the outer wall of control tube. The term "continuous" is used to indicate a path that moving forward along the path from an initial point returns to the initial point. Position E of one pattern is Position A of the next pattern.

Figure 10A:
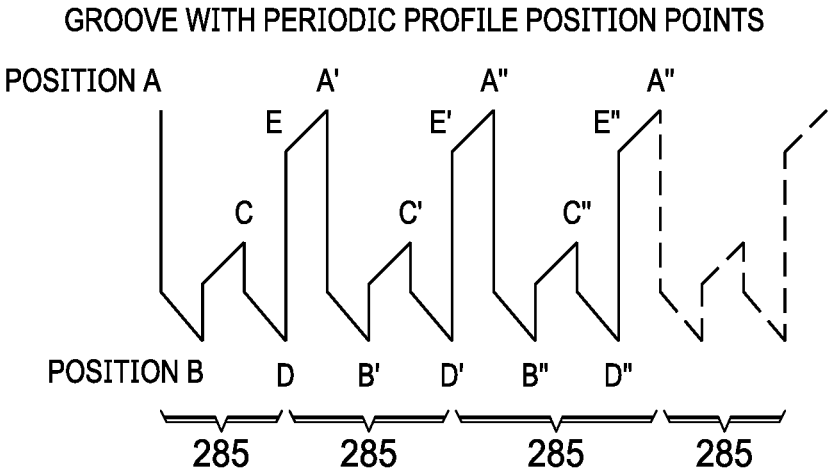
FIG. 10A is a schematic of a linear version of a guide path 284 and FIG. 10B shows the guide track as arranged on the body of a bottom hole assembly.
Figure 10B:
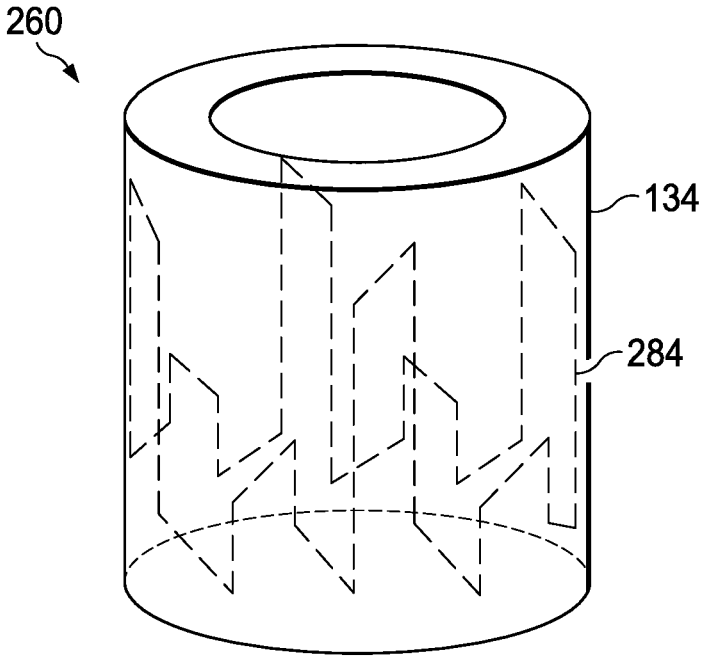
Figure 11A:
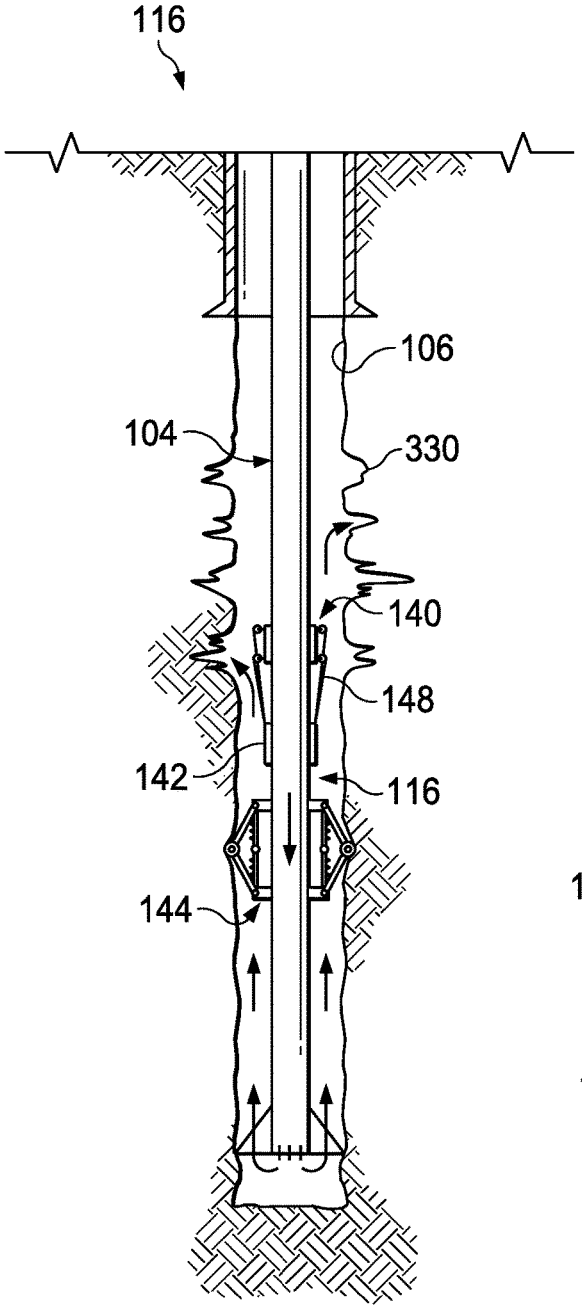
Figure 11B:
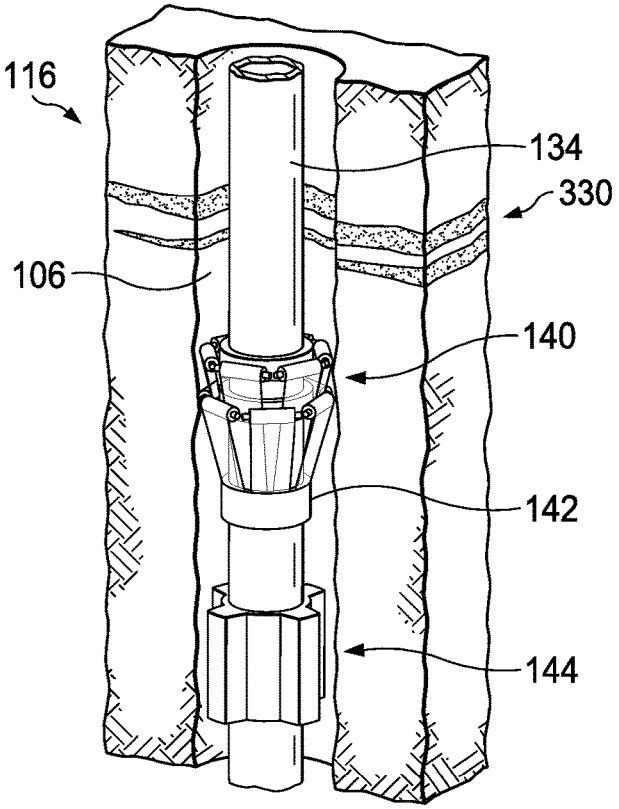
FIGS. 11B, 12B, 13B, 14B, 15B, 16B, 17B, and 18B are perspective views of the bottom hole assembly in the wellbore.
Figure 11C:
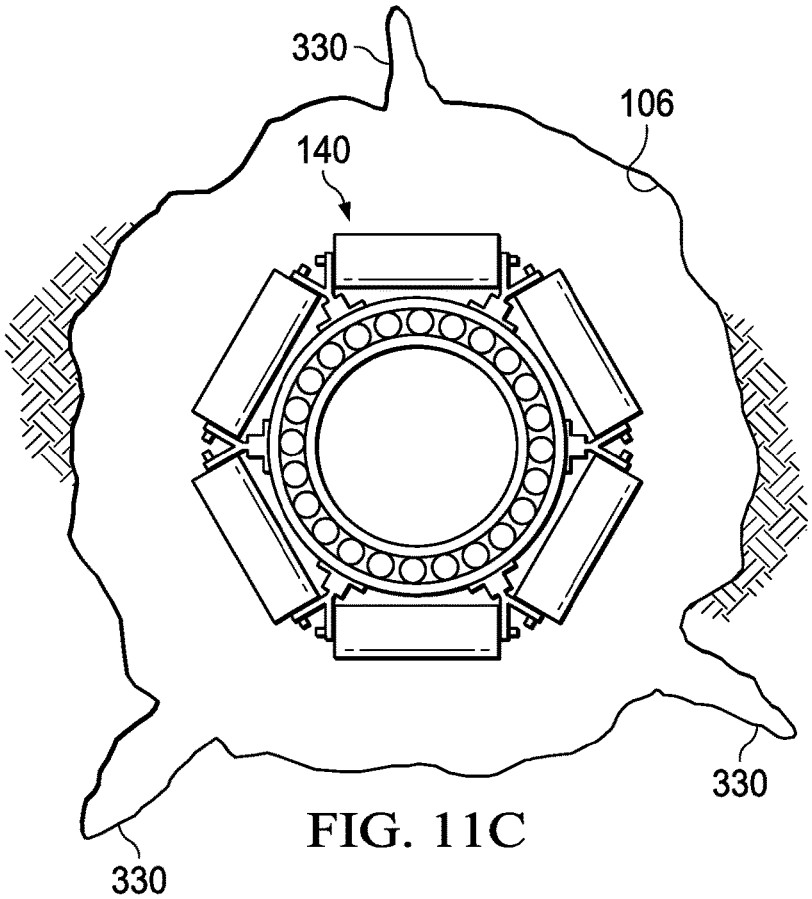
Figure 11D:
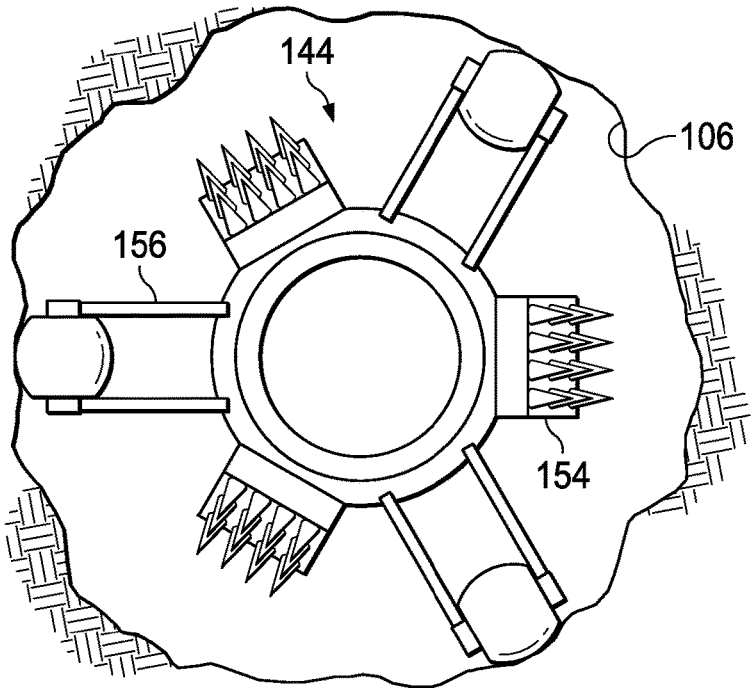
FIGS. 11D, 12D, 13D, 14D, 15D, 16D, and 17D are schematic plan views of the combined roller-underreamer assembly of the bottom hole assembly.
Figure 12A:
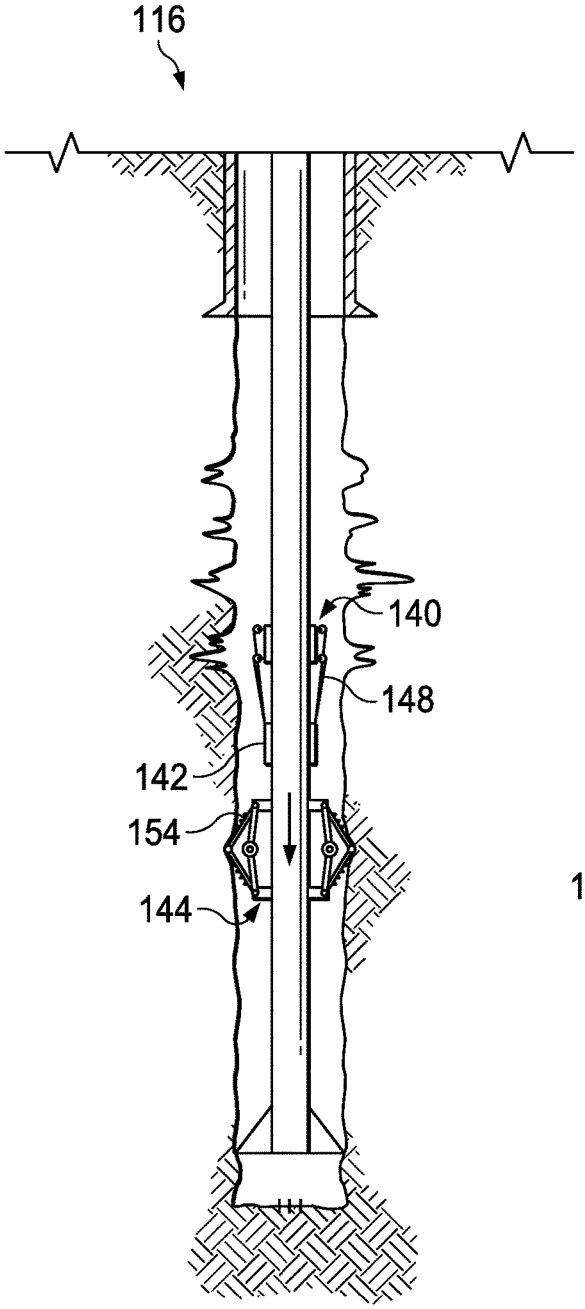
Figure 12B:
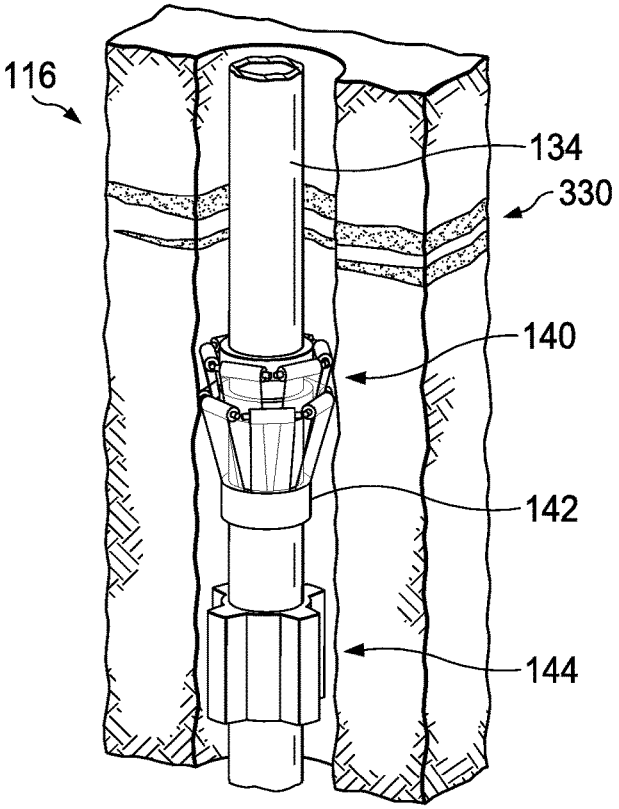
Figure 12C:
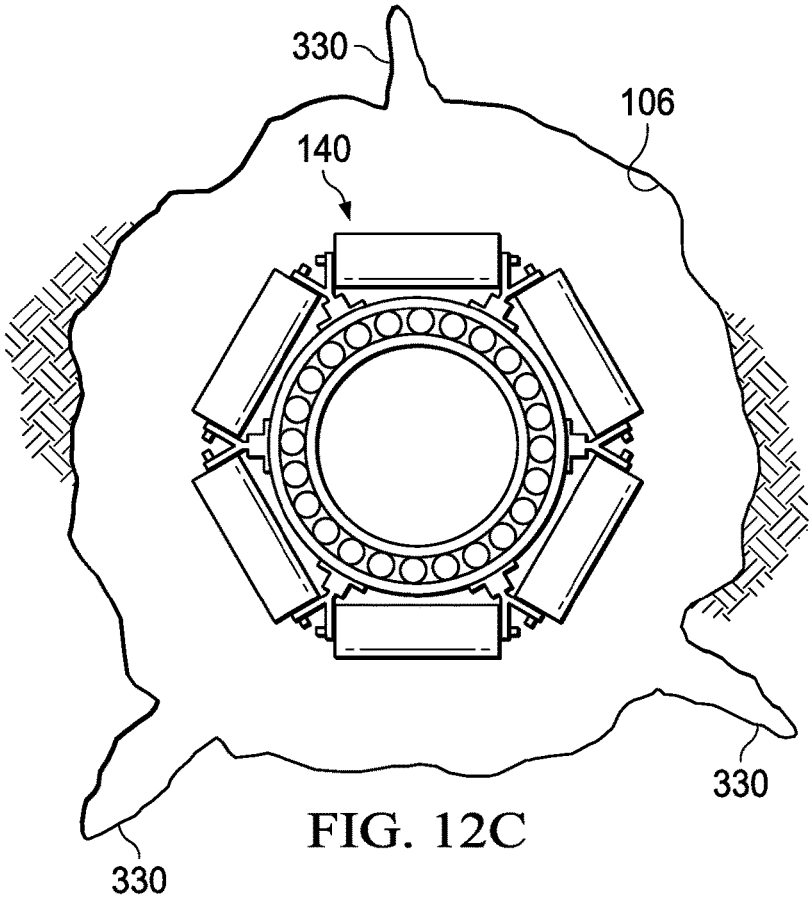
Figure 12D:
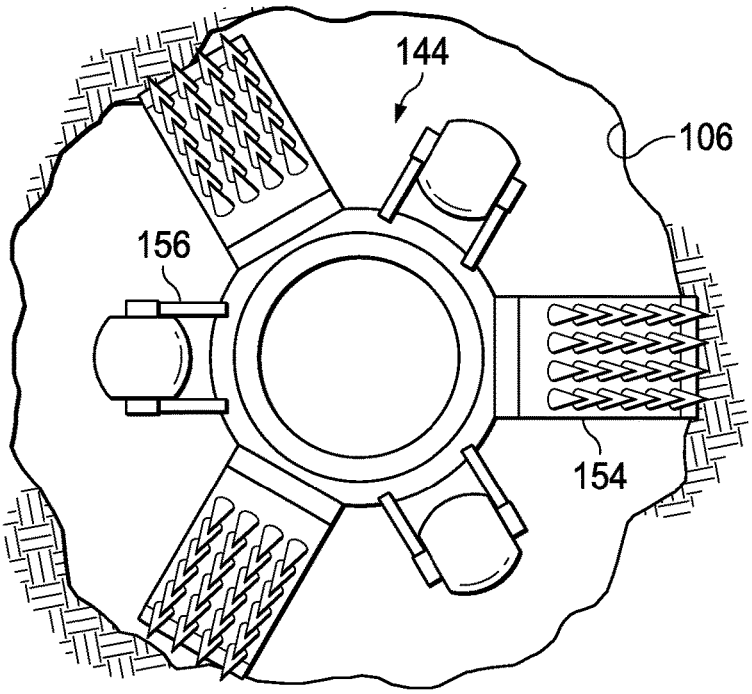
Figure 13A:
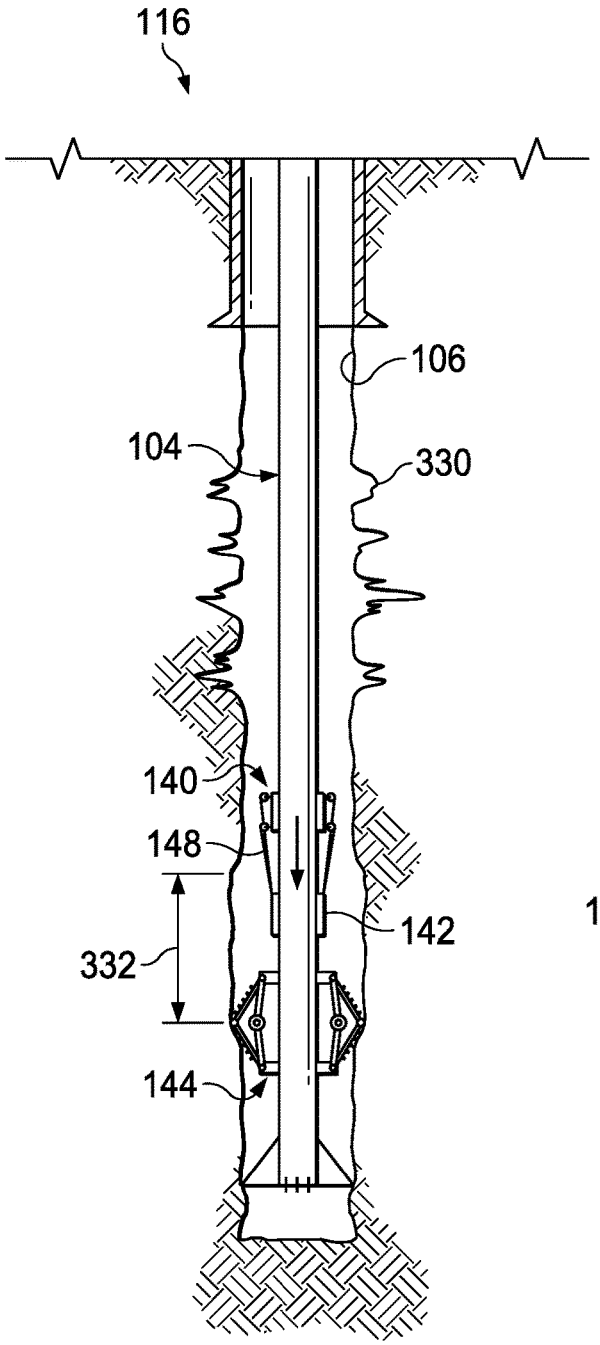
Figure 13B:
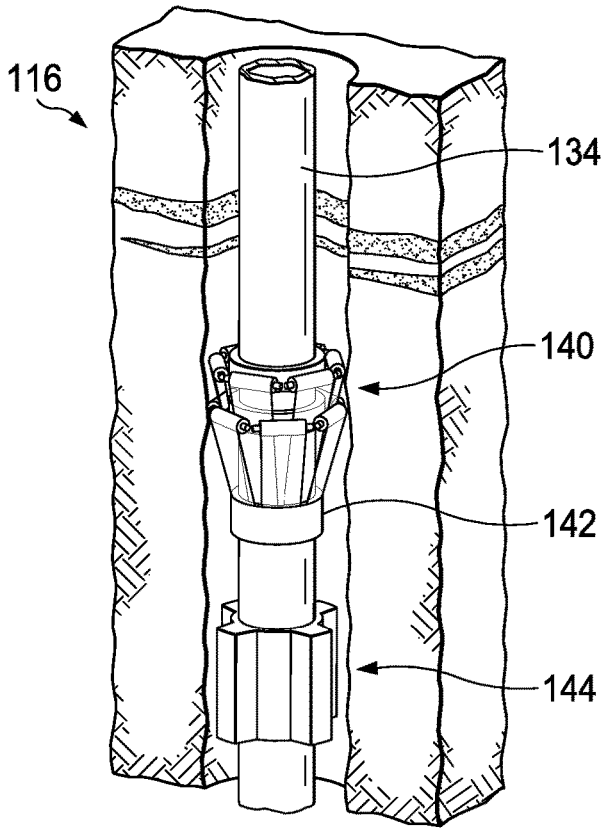
Figure 13C:
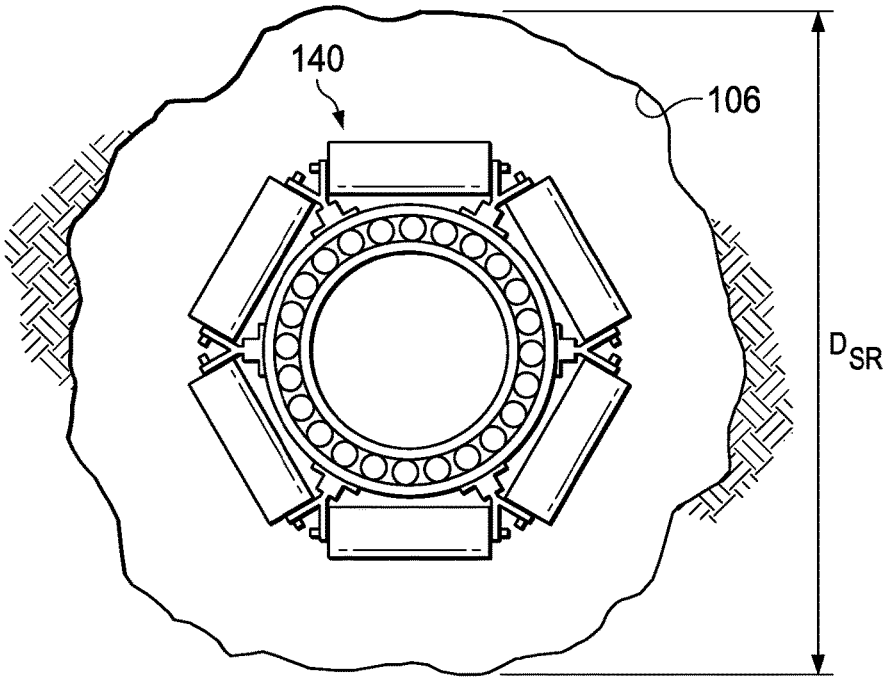
Figure 13D:
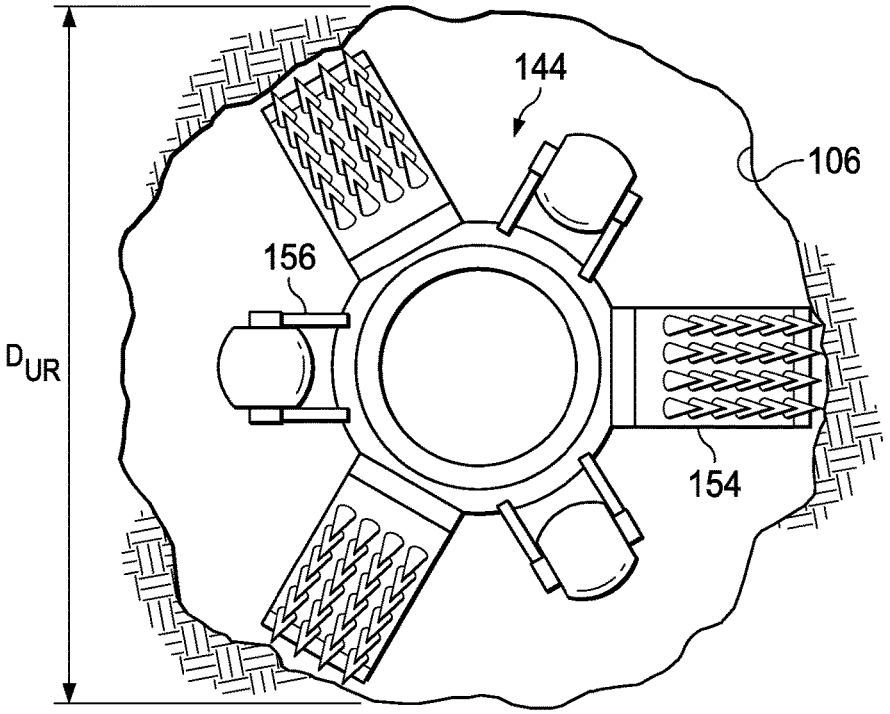
Figure 14A:
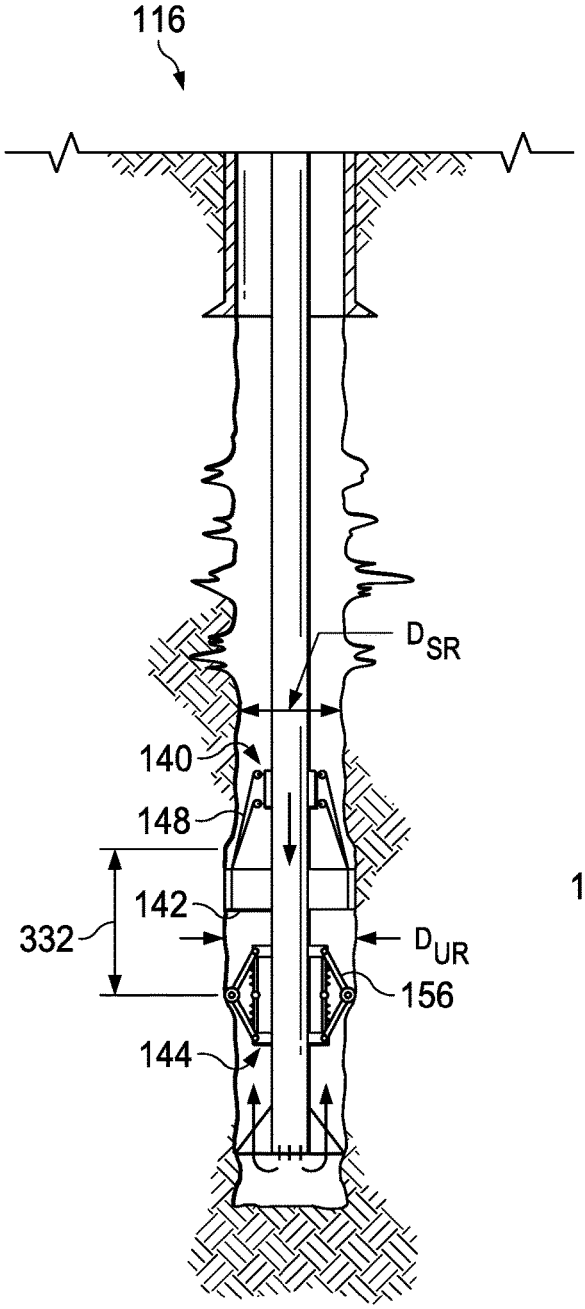
Figure 14B:
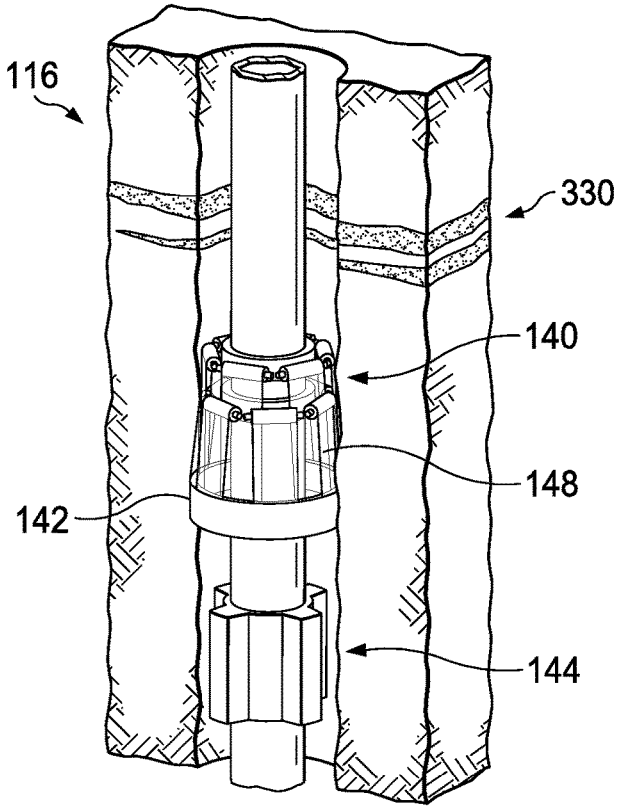
Figure 14C:
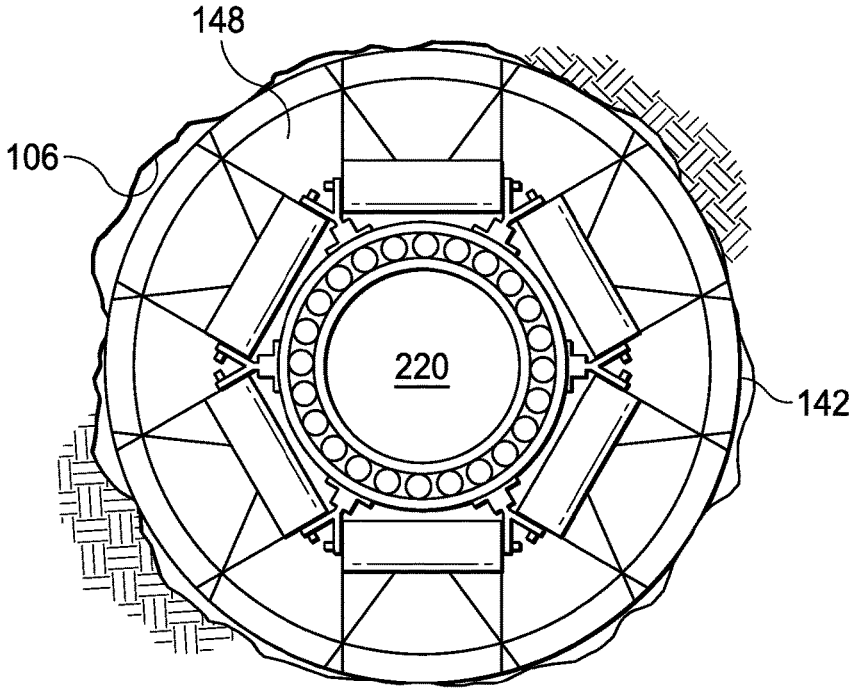
Figure 14D:
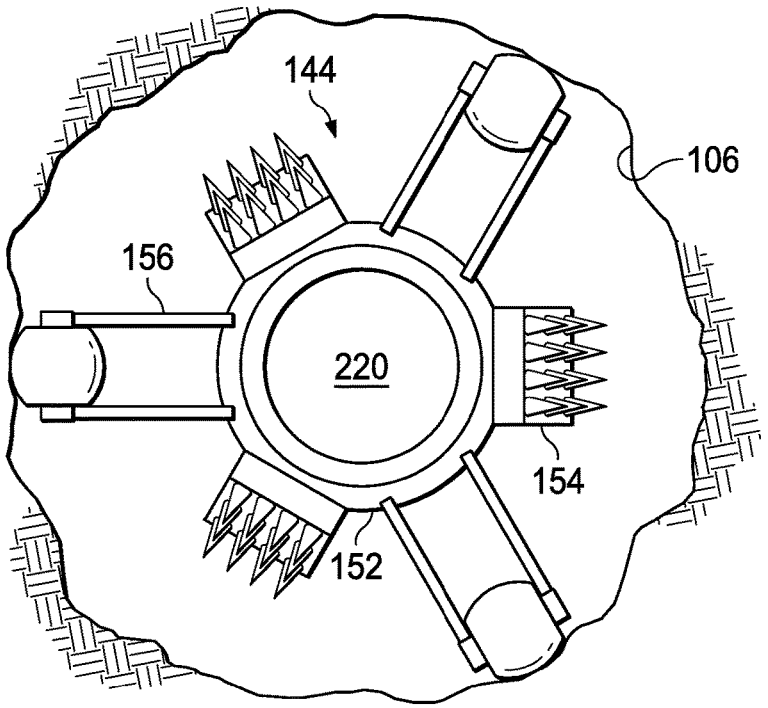
Figure 15A:
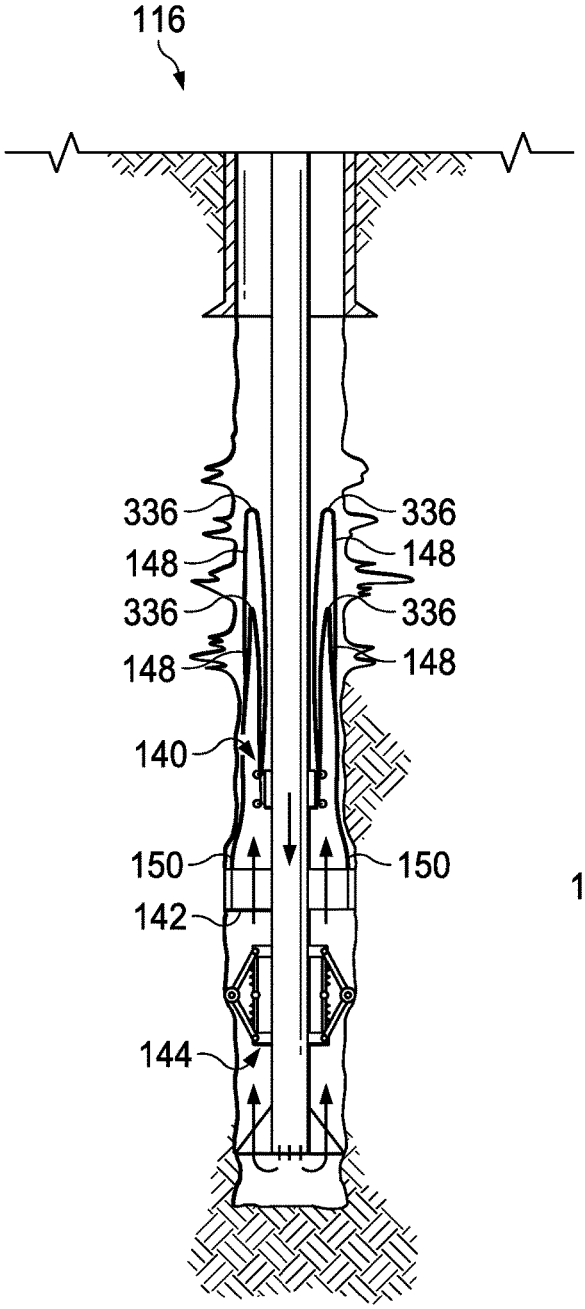
Figure 15B:
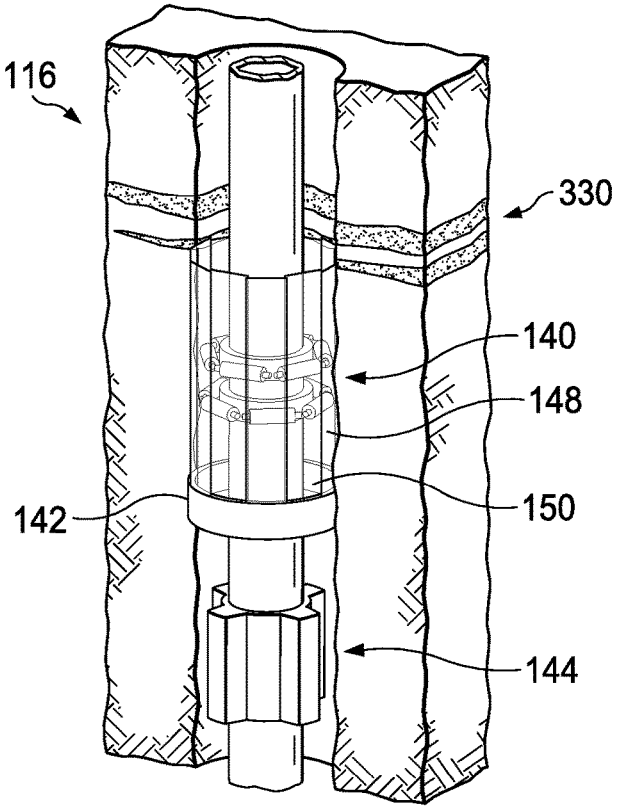
Figure 15C:
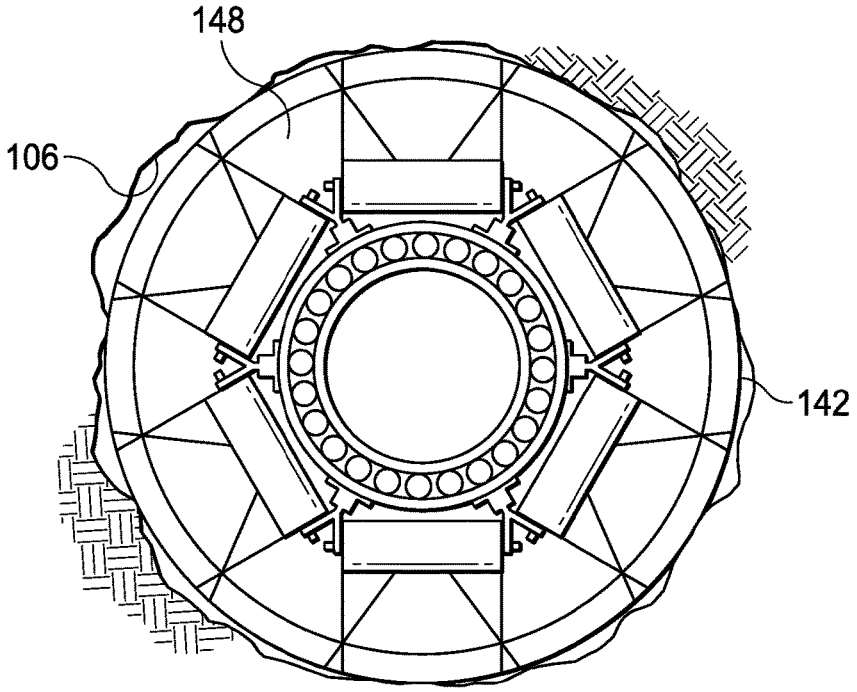
Figure 15D:
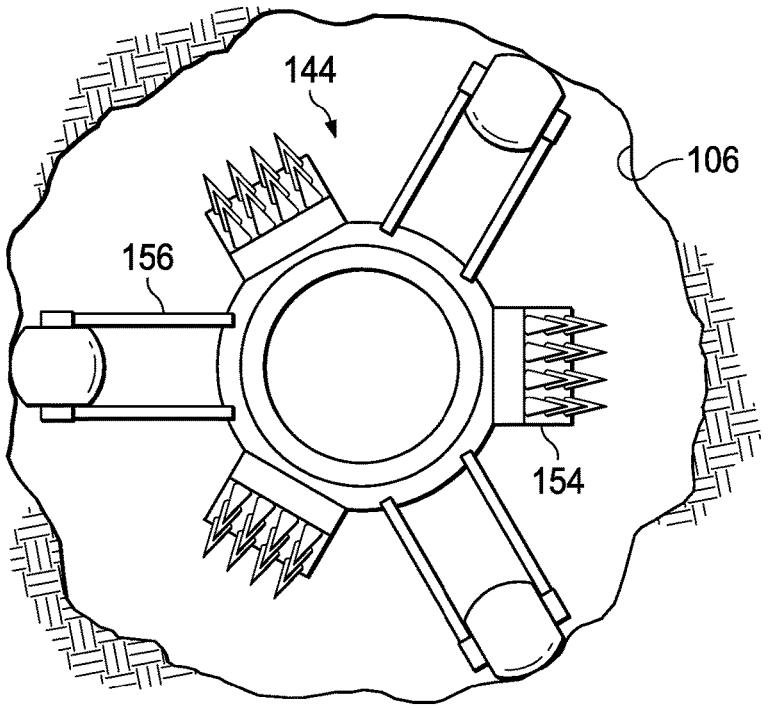

FIG. 10A is a schematic of a linear version of the guide path 284. FIG. 10B shows the guide track 284 as arranged on the body 134. The pattern 285 repeats around the circumference of the body 134 so that the cam 282 seamlessly transitions from one pattern to the next. For example, position A and position A' are the same position on different patterns, and position E connects directly to position A' to connect the two different patterns. The pattern 285 may repeat a number of times, such that the guide track has an A/B/C/D/E pattern, an A'/B'/C'/D'/E' pattern, and an A"/B"/C"/D"/E" pattern. In such a configuration, the E" position would connect back to the A position to complete the guide path 284.

Figure 9B:
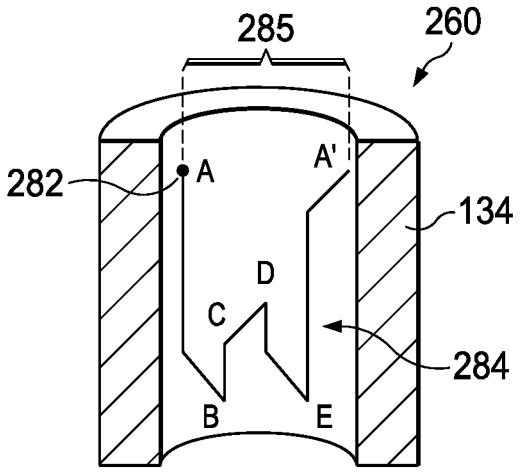

FIG. 9B shows the guide path 284 engaged with the cam 282 at the initial first position (position A). FIG. 9D shows the guide path 284 engaged with the cam 282 at the second position (position B). FIG. 9F shows the guide path 284 engaged with the cam 282 at the fourth position (position D). FIG. 9H shows the guide path 284 engaged with the cam 282 at the fifth position (position E). FIG. 9J shows the guide path 284 engaged with the cam 282 at a repeated first position (position A'). The guide path 284 and cam 282 control the position of the combined roller-underreamer assembly 144. Position A of the cam 282 corresponds with the reaming position of the combined roller-underreamer assembly 144. Position D of the cam 282 corresponds with the rolling position of the combined roller-underreamer assembly 144. As the cam 282 moves through a diagonal portion of the guide path, for example A to B or C to D, the cam also rotates relative to the body 134, control tube 286, and finger 288.

To move the combined roller-underreamer assembly 144 from the rolling position to the reaming position, an actuator, for example, a ball engages the finger 288 and moves it downhole. As described with reference to FIGS. 6A-6C, a first ball 314 is inserted into the drill string 104 at the surface. Drilling fluid and gravity carry the first ball 314 through the drill string 104 and into the body 134 of the bottom hole assembly 116, as shown in FIG. 9A. The first ball 314 then engages with the finger 288 and pulls the finger 288, control tube 286, and cam 282 axially downhole with the flow of the drilling fluid against the biasing force of the first spring 290. As the control tube 286 moves away from the uphole boundary 292 of the recess 274, the fluid port 294 is exposed to the drilling fluid in the interior cavity 220 of the body 134.

Figure 9C:
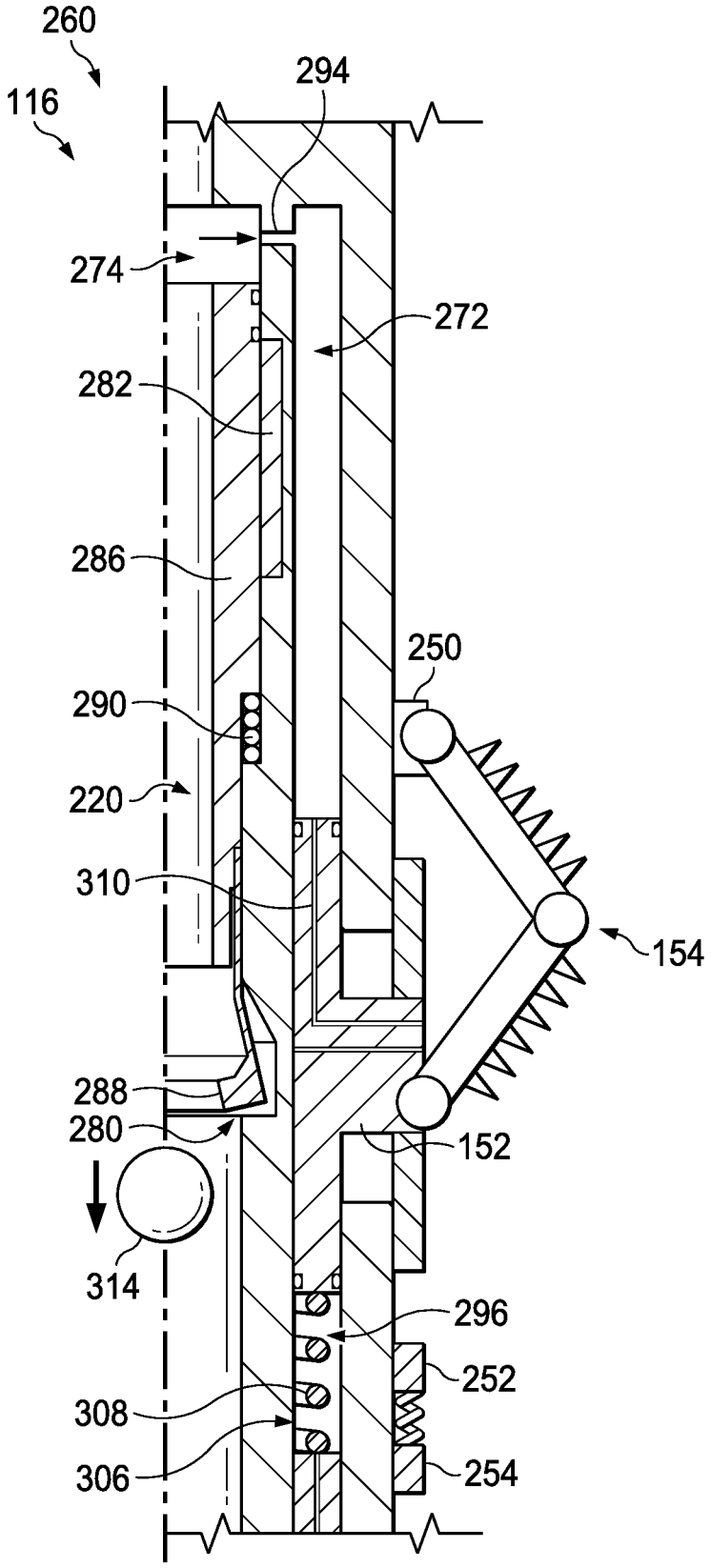
Figure 9D:
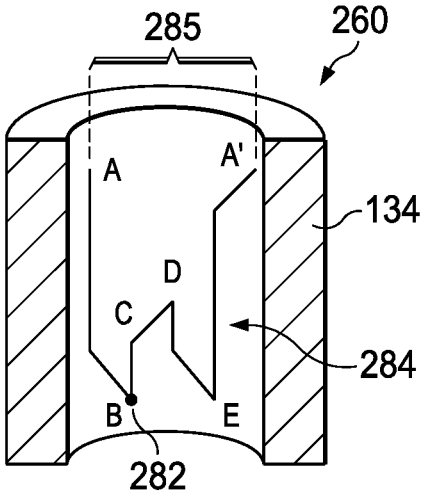
Figure 9E:
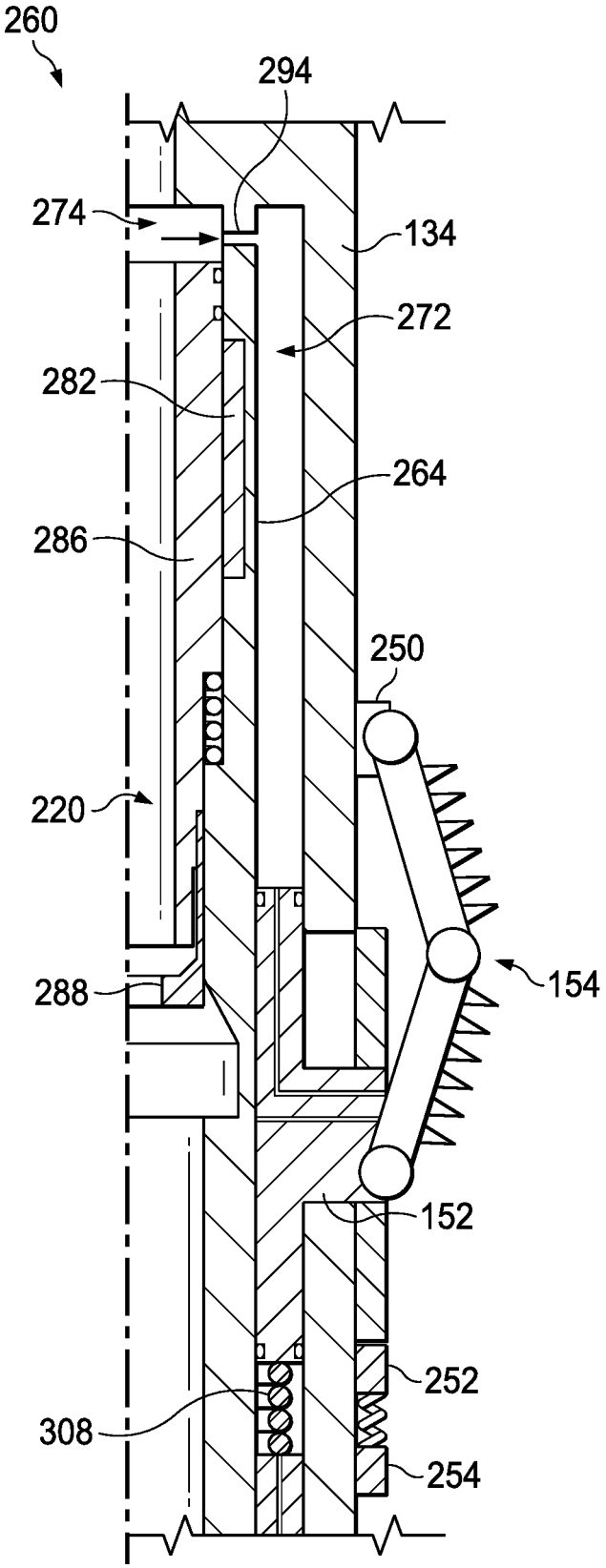
Figure 9F:
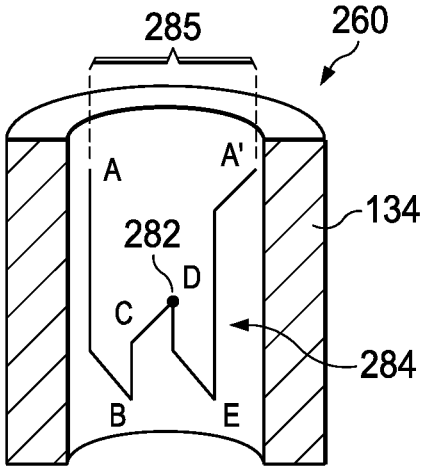

In FIG. 9C, the finger 288 is received by the second notch 280, and flexes into the notch releasing the first ball 314. At this point, the first spring 290 is fully compressed, the cam 282 is in position B, and drilling fluid enters the first interior chamber 262 via the fluid port 294. The drilling fluid in the first interior chamber 262 applies a force to the uphole end 270 of the set tube 152 and begins to apply enough pressure to move the set tube 152 downhole against the biasing force of the second spring 308. FIG. 9C illustrates a transitional position between the rolling position and the reaming position. The set tube 152 is equidistant between the first ring 165 and the uphole portion 252 of the second ring 177.

Once the first ball 314 is released when the cam 282 is in position B, the first spring 290 presses the control tube 286 uphole moving the cam 282 from position B, through position C and into position D. In position D, the guide path prevents the cam 282 and the control tube 286 from continuing to move uphole. When the cam 282 is in position D, the control tube 286 does not cover the fluid port 294. The finger 288 relaxes back to its initial configuration, in which a ball could engage the finger 288. Additional fluid continues to flow through the fluid port 294 and presses the set tube 1523 downhole, until the movable member hits a stop surface 316 of the body 134. At this point, the second spring 308 is fully compressed and the combined roller-underreamer assembly 144 is in the rolling position. The combined roller-underreamer assembly 144 maintains this position due to exposure of the uphole end of the set tube 152 to pressure of drilling fluid inside the drill string.

Figure 9G:
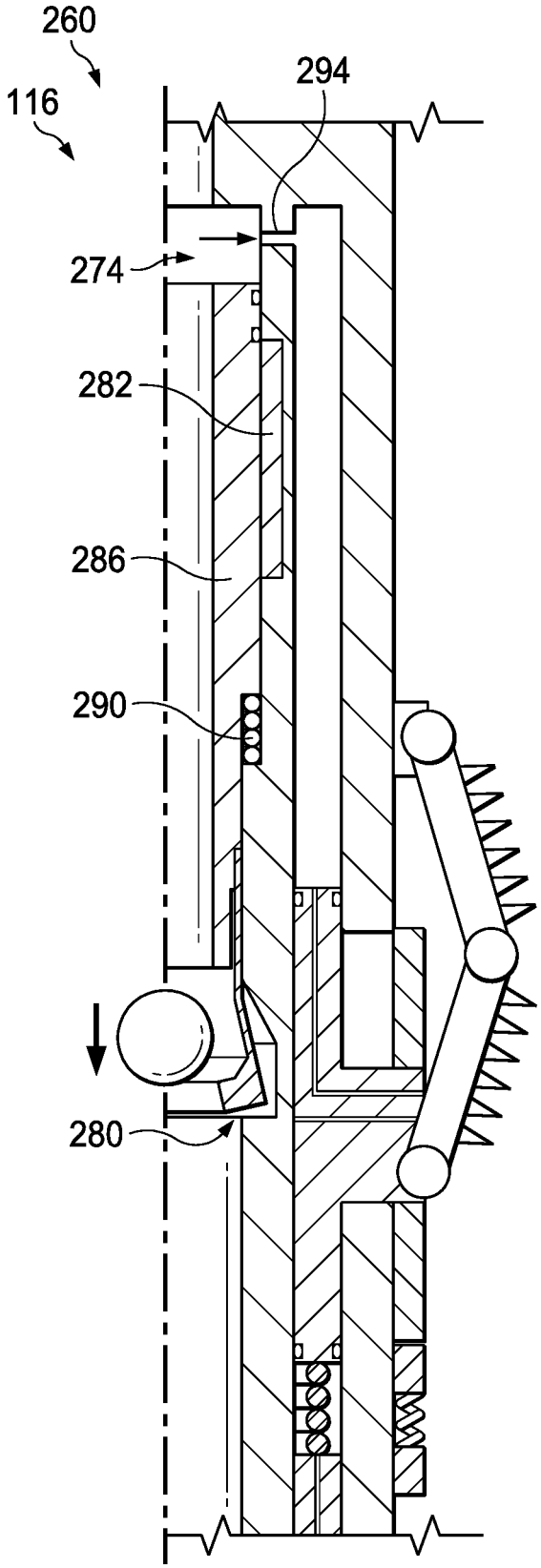
Figure 9H:
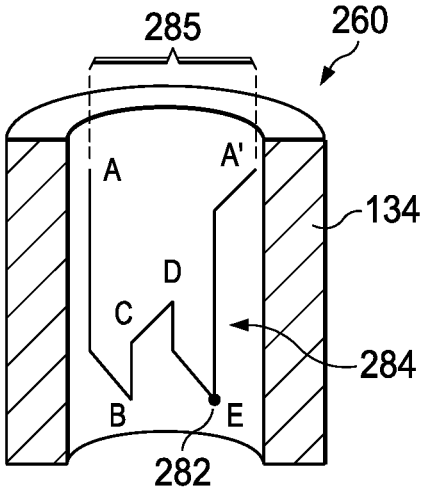
Figure 9I:
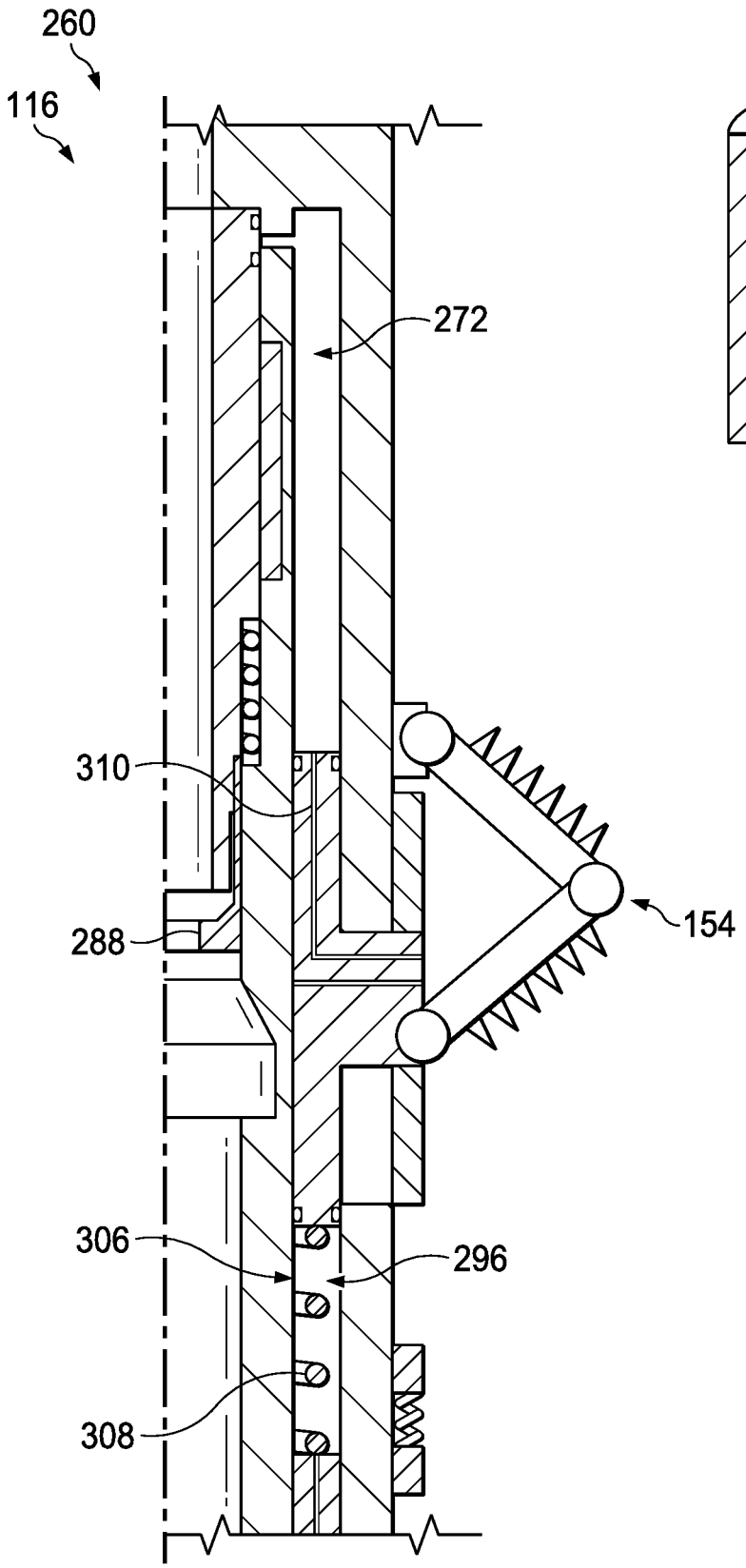
Figure 9J:
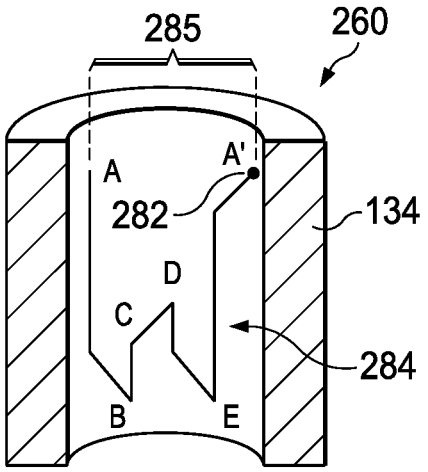

The combined roller-underreamer assembly 144 remains at this position until the reaming position is desired. To return to the reaming position, a second mechanical actuator, for example a second ball 318, is loaded into the drill string 104. The cam 282, in position D, is free to move axially downhole provided a sufficient force overcomes the biasing force of the first spring 290. Like first ball 314, the second ball 318 flows through the drill string to engage the finger 288, as shown in FIG. 9G. The cam 282, finger 288, and control tube 286 move axially downhole, against the bias of the first spring 290 until the finger 288 flexes and disengages the ball 318. At this point the cam 282 is at position E. When the ball is released, the first spring 290 moves the cam 282, the finger 288, and the control tube 286 uphole. The cam 282 moves from position E to position A' and the tube element returns to abut the uphole boundary 292 of the recess 274, as shown in FIG. 9I.

The return of the control tube 286 to its initial position covers the fluid port 294 and removes fluid connection between the interior of the body 134 and the first interior chamber 262. The fluid in the interior chamber at least partially drains out of the first equalizing port 310 thereby removing the compressive force on the second spring 308. The second spring moves the set tube 152 uphole into the reaming position. The combined roller-underreamer assembly 144 will remain in the reaming position until the fluid port 294 is reopened by a third actuator.

Figure 17A:
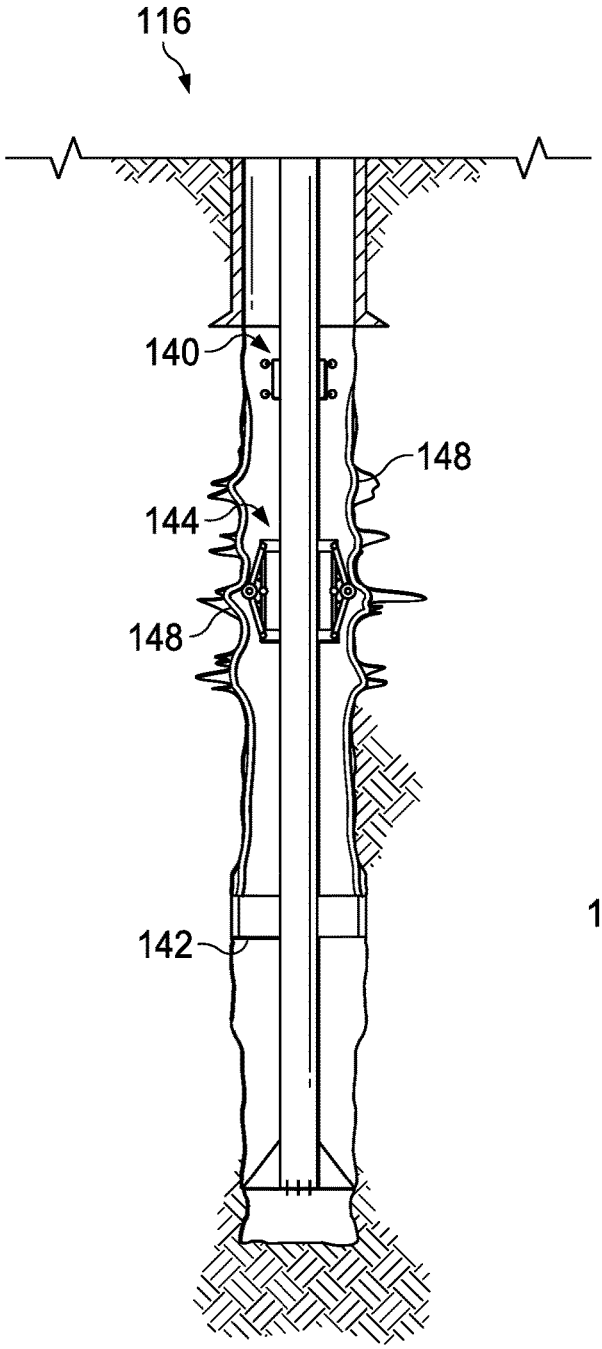
Figure 17B:
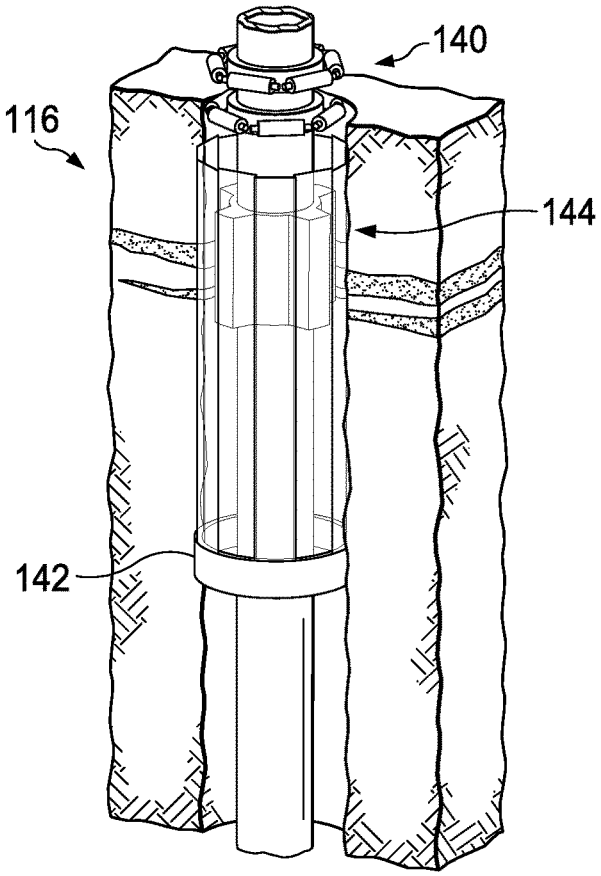
Figure 17C:
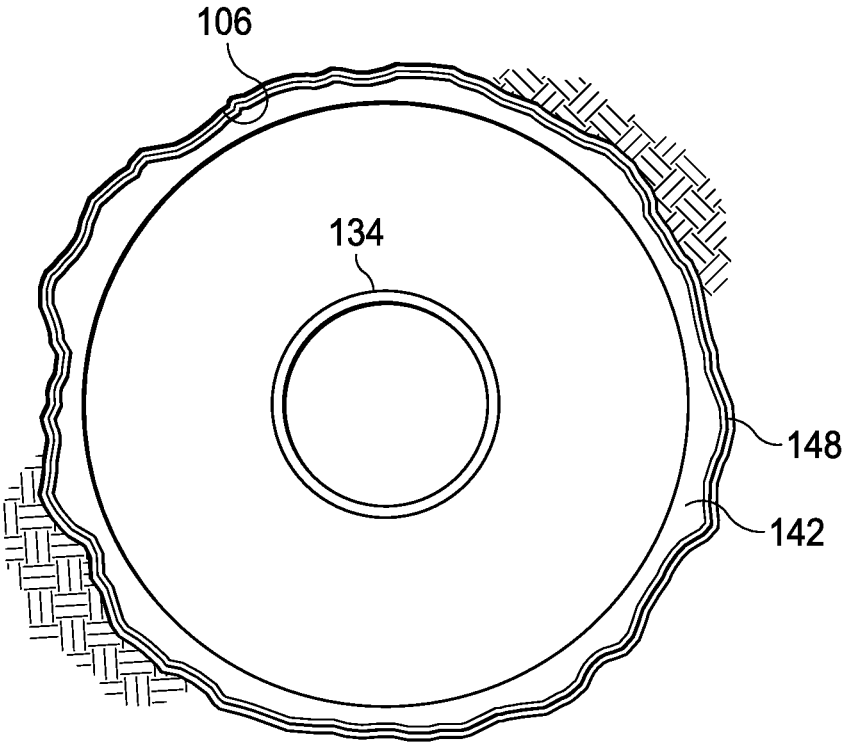
Figure 17D:
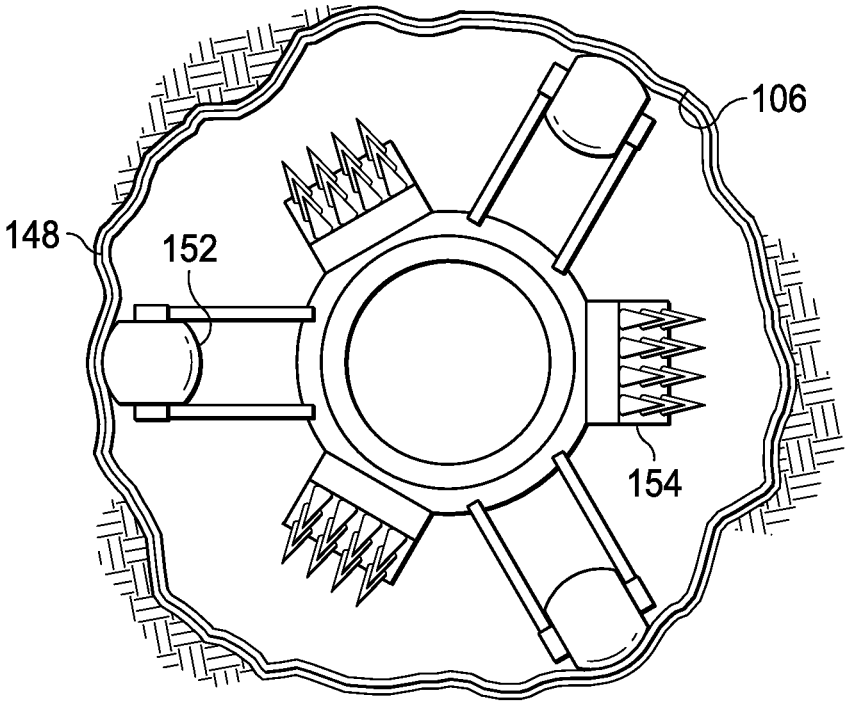
Figure 18A:
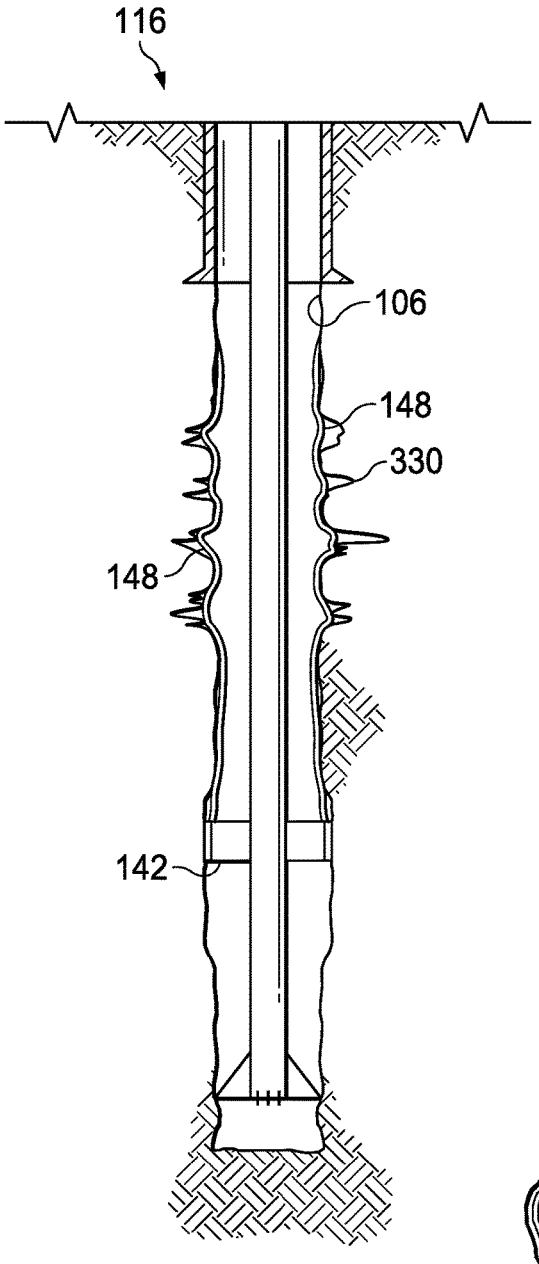
Figure 18B:
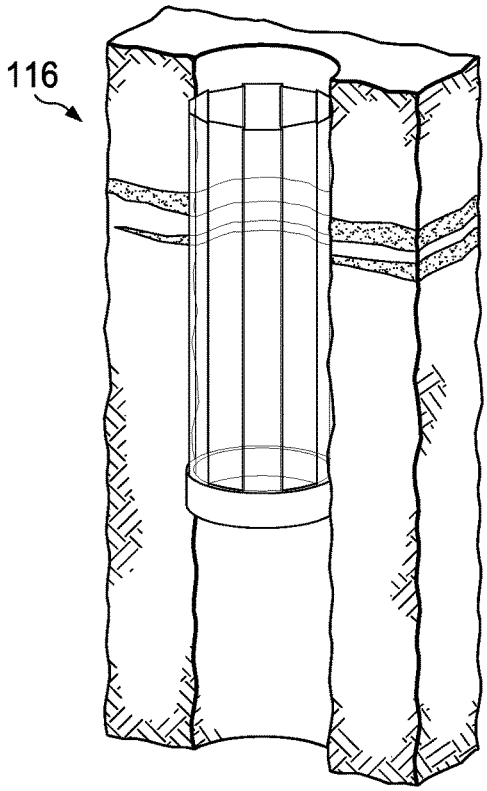
Figure 18C:
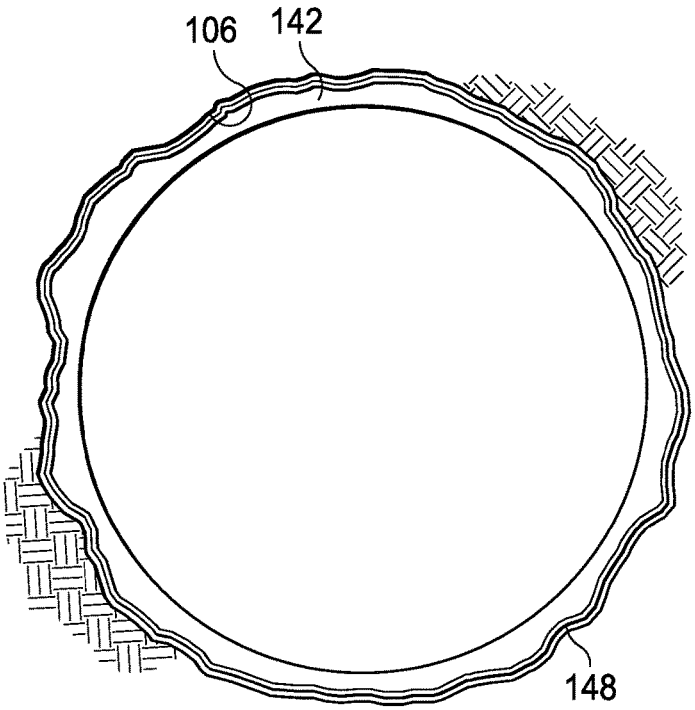
Figure 19:
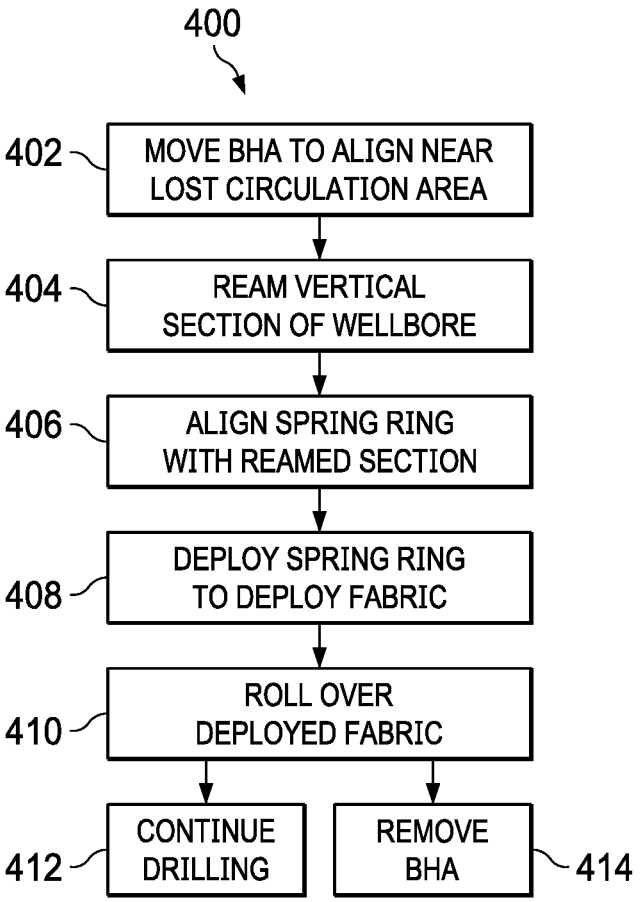
FIG. 19 is a flowchart of a method 400 for deploying the lost circulation fabric 148 in a wellbore 106. The method 400 is described with reference to FIGS. 11A-18C.

FIGS. 11A-18C illustrate operation of the bottom hole assembly 116. FIGS. 11A, 12A, 13A, 14A, 15A, 16A, 17A, and 18A are schematic side views of the bottom hole assembly 116 in the wellbore 106. FIGS. 11B, 12B, 13B, 14B, 15B, 16B, 17B, and 18B are perspective views of the bottom hole assembly 116 in the wellbore 106. FIGS. 11C, 12C, 13C, 14C, 15C, 16C, 17C, and 18C are schematic plan views of the spool ring 140 of the bottom hole assembly 116 in the wellbore 106. FIGS. 11D, 12D, 13D, 14D, 15D, 16D, and 17D are schematic plan views of the combined roller-underreamer assembly 144 of the bottom hole assembly 116 in the wellbore 106. FIG. 19 is a flowchart of a method 400 for deploying the lost circulation fabric 148 in a wellbore 106. The method 400 is described with reference to FIGS. 11A-18C.

In FIGS. 11A-11D, the bottom hole assembly 116 translates by the drill string 104 to a lost circulation area 330 of the wellbore 106 (step 402). At the lost circulation area 330, drilling fluid exits the wellbore 106 and cannot be retrieved for later processing and manufacturing. Once the lost circulation area 330 is located, the bottom hole assembly positioned with the combined roller-underreamer assembly 144 is slightly downhole of the lost circulation area 330, for example about 10 ft. to about 100 ft. During translation of the bottom hole assembly 116, the combined roller-underreamer assembly 144 is in the rolling position. When aligned slightly below the downhole assembly, the positioning system 260 is activated to move the combined roller-underreamer assembly 144 from the rolling position to the reaming position, as shown in FIGS. 12A-12D. Once secured in the reaming position, the drill string 104 rotates. The body 134 of the bottom hole assembly 116 and all attached components (the spool ring 140, the spring ring 142, and the combined roller-underreamer assembly 144) rotate with the drill string 104. The teeth 169 on the reamer arms 154 loosen and cut the formation 108 during rotation. The reamer arms 154 engage the walls of the wellbore 106 and enlarge the cross section of the wellbore 106. The drill string 104 moves axially downhole or uphole to enlarge a section 332 (reamed section) of the wellbore 106 (step 404). The reamed section 332 has a diameter $D_{UR}$. The portion of the wellbore 106 that aligns with the spool ring 140 has a diameter $D_{SR}$. The diameter $D_{UR}$ is larger than the diameter $D_{SR}$.

In FIGS. 13A-13D, the positioning system 260 is actuated a second time and the combined roller-underreamer assembly 144 moves from the reaming position to the rolling position. The drill string 104, with the bottom hole assembly 116, moves axially downhole to align the spring ring 142 with the reamed section 332 (Step 406). The spring release 210 is actuated to move the locking member 204 and release the locking pin 196. The spring ring 142 moves from its compressed position to its relaxed position and abuts the reamed section 332 of the wellbore 106 (step 408), as shown in FIGS. 14A-14D. In this configuration, the lost circulation fabric 148 extends from the reamed section 332 of the wellbore 106 to the drill string 104 across the flow of drilling fluid up the annulus between the drill string and walls of the wellbore.

Figure 16A:
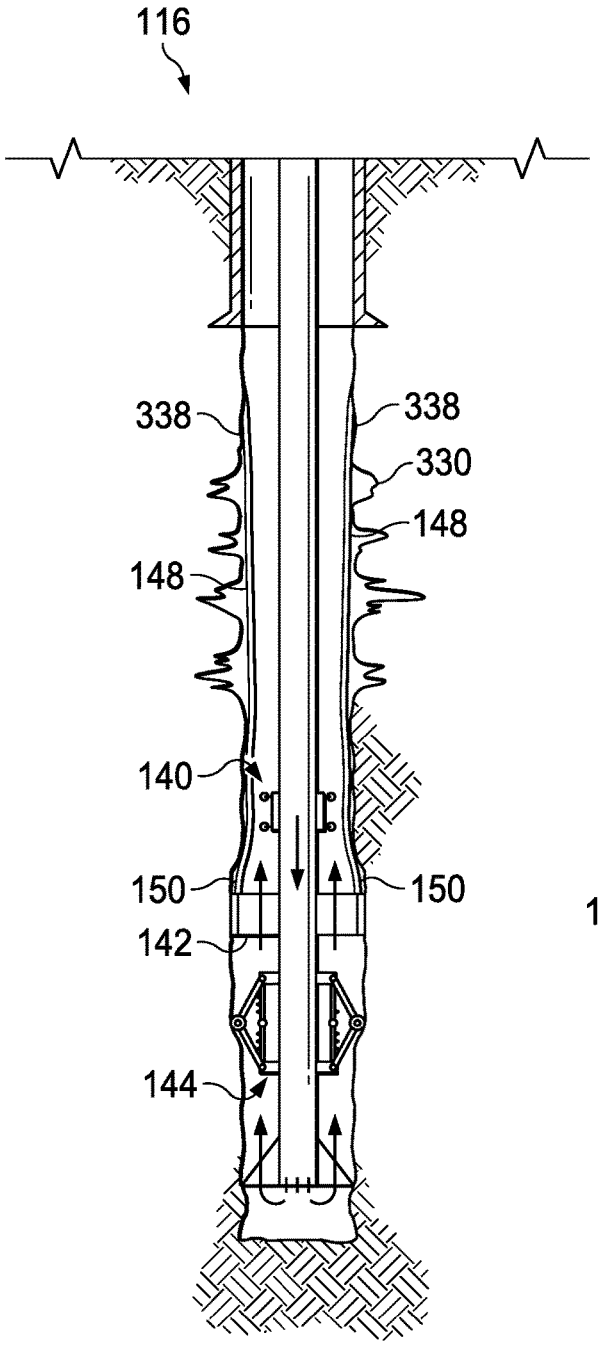
Figure 16B:
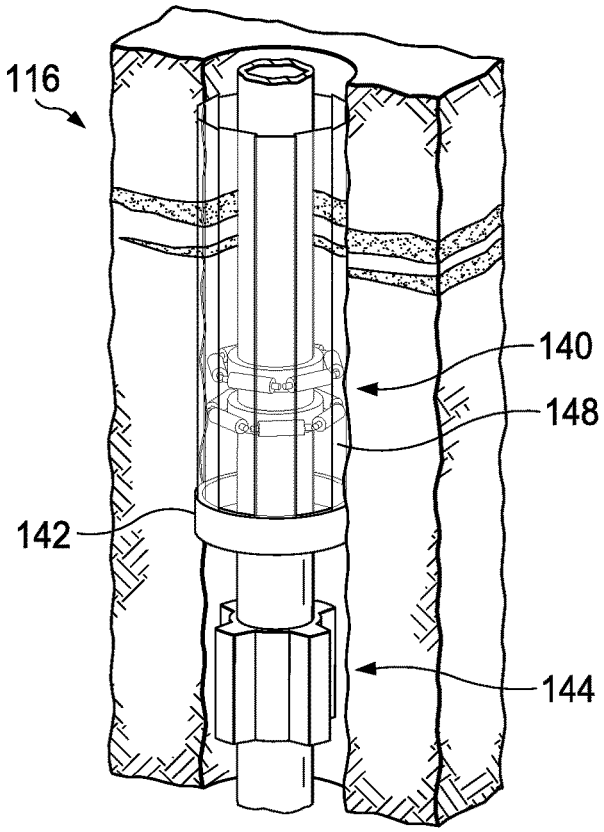
Figure 16C:
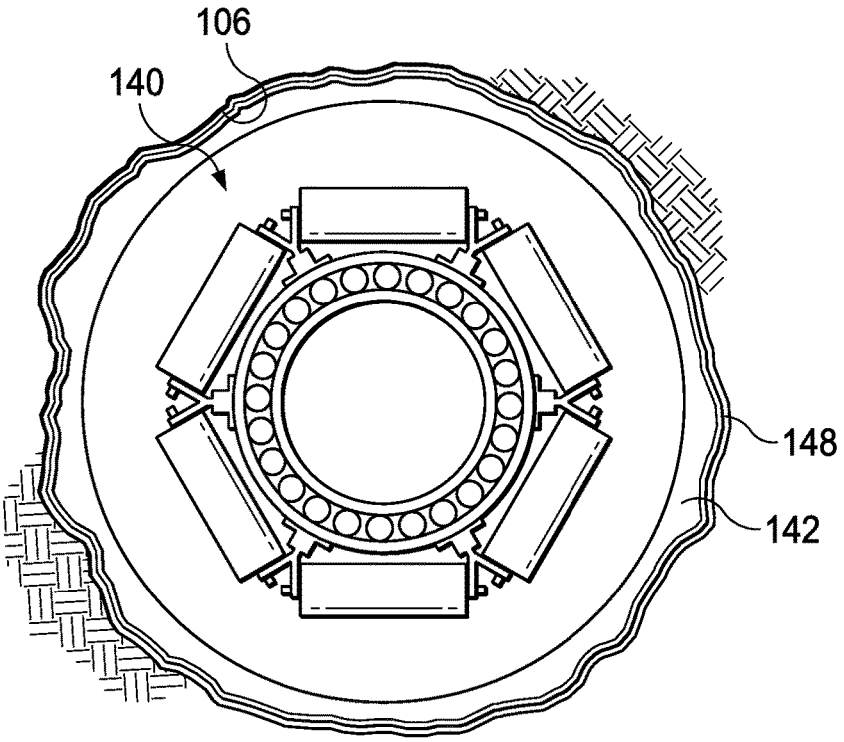
Figure 16D:
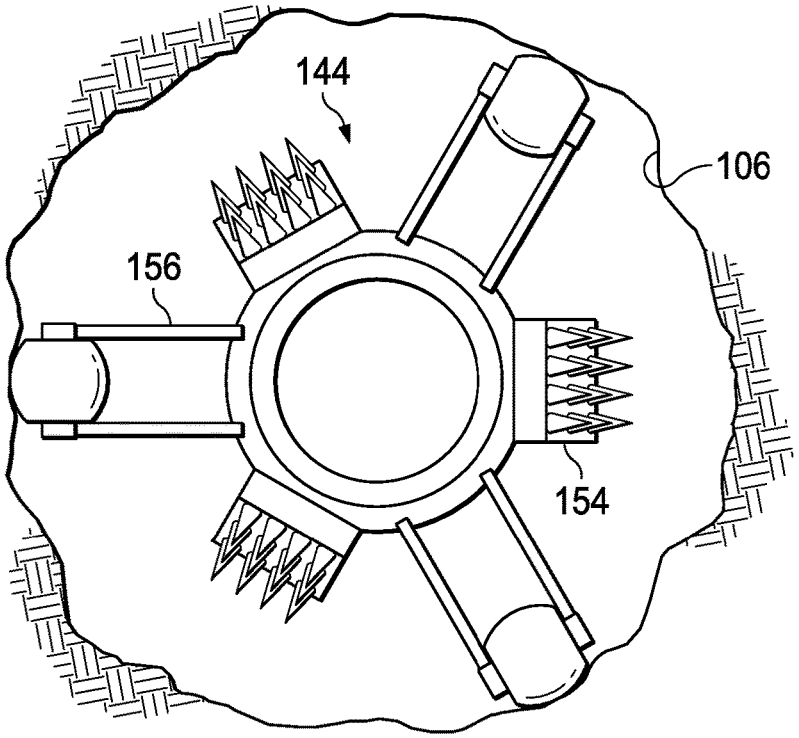

FIGS. 15A-15D show the lost circulation fabric 148 being deployed with the uphole flow of the drilling fluid begins to pull the lost circulation fabric off the spools. The first end 150 of the lost circulation fabric 148 remains attached to the spring ring 142. The drilling fluid balloons a middle section 336 of the lost circulation fabric uphole, in the direction of the drilling fluid flow. The spools 146 rotate to release the lost circulation fabric 148 as the middle section 336 extends uphole. Eventually a second end 338 of the lost circulation fabric releases from the spool 146 and flows uphole. The uphole flow of the drilling fluid presses the lost circulation fabric 148 against the walls of the wellbore 106, covering the lost circulation area 330, as shown in FIGS. 16A-16D. In addition, the differential pressure between the lost circulation area 330 and the wellbore 106 helps adhere the lost circulation fabric 148 to the wall of the wellbore 106. As previously discussed, the first and second sets 186, 188 of the spools 146 on the spring ring 142 overlap so that the entire circumference of the wellbore wall is covered in lost circulation fabric 148, as shown in FIGS. 16B, 17B, and 18B.

In FIGS. 17A-17D, the lost circulation fabric 148 is deployed. To further adhere the lost circulation fabric 148 to the wellbore 106, the drill string 104 is translated uphole so that the rollers 178 of the combined roller-underreamer assembly 144 abut the walls of the wellbore 106 and press the lost circulation fabric 148 to the walls of the wellbore 106 (step 410). The drilling system 100 may then resume drilling (step 412) or the bottom hole assembly 116 may be completely removed (step 414). The lost circulation fabric 148 and the spring ring 142 remain in the wellbore 106 during and after drilling. When drilling has completed, the drill string 104 is completely removed from the wellbore 106.

Figure 20A:
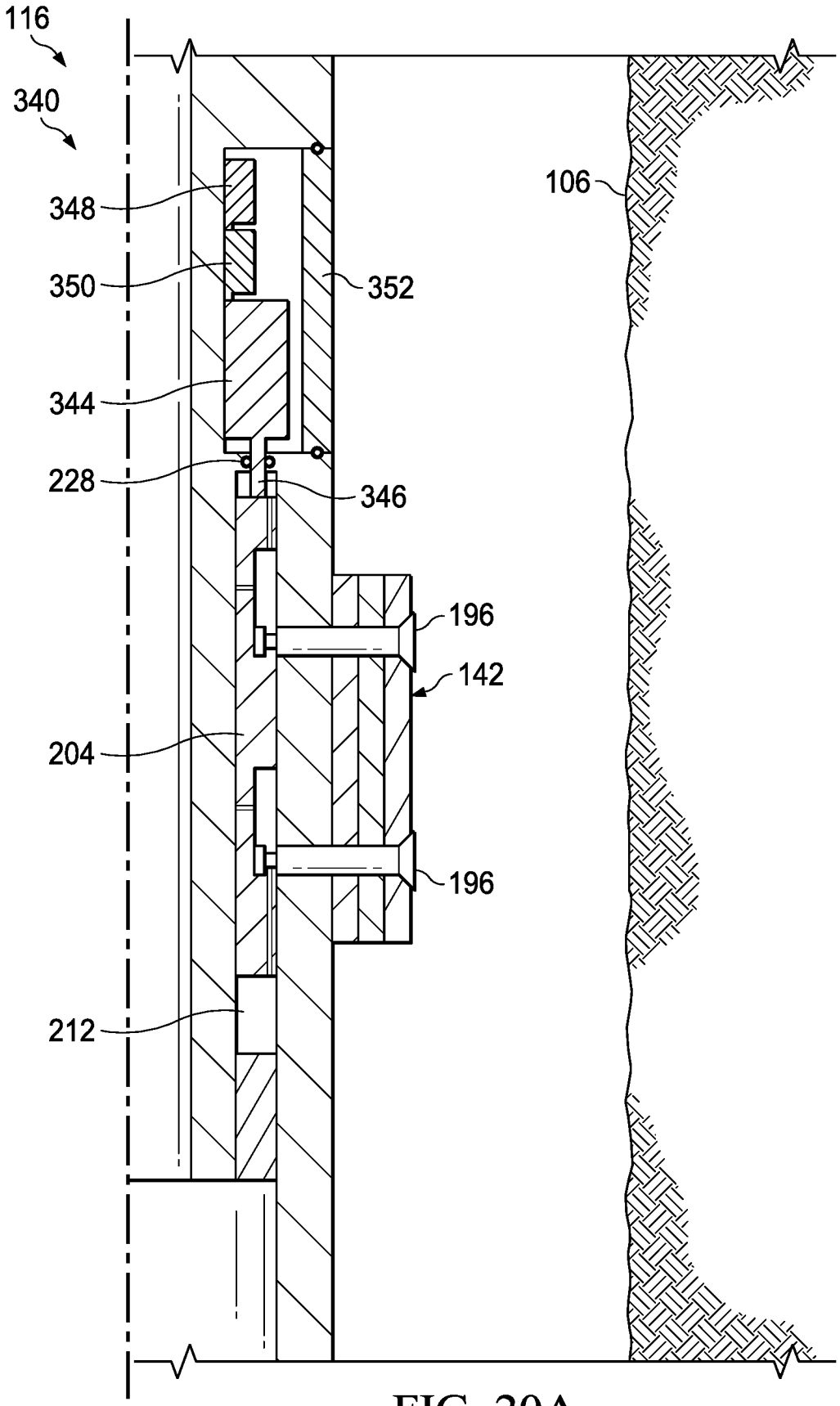
FIGS. 20A and 20B are cross-sectional side views of a spring release mechanism.
Figure 20B:
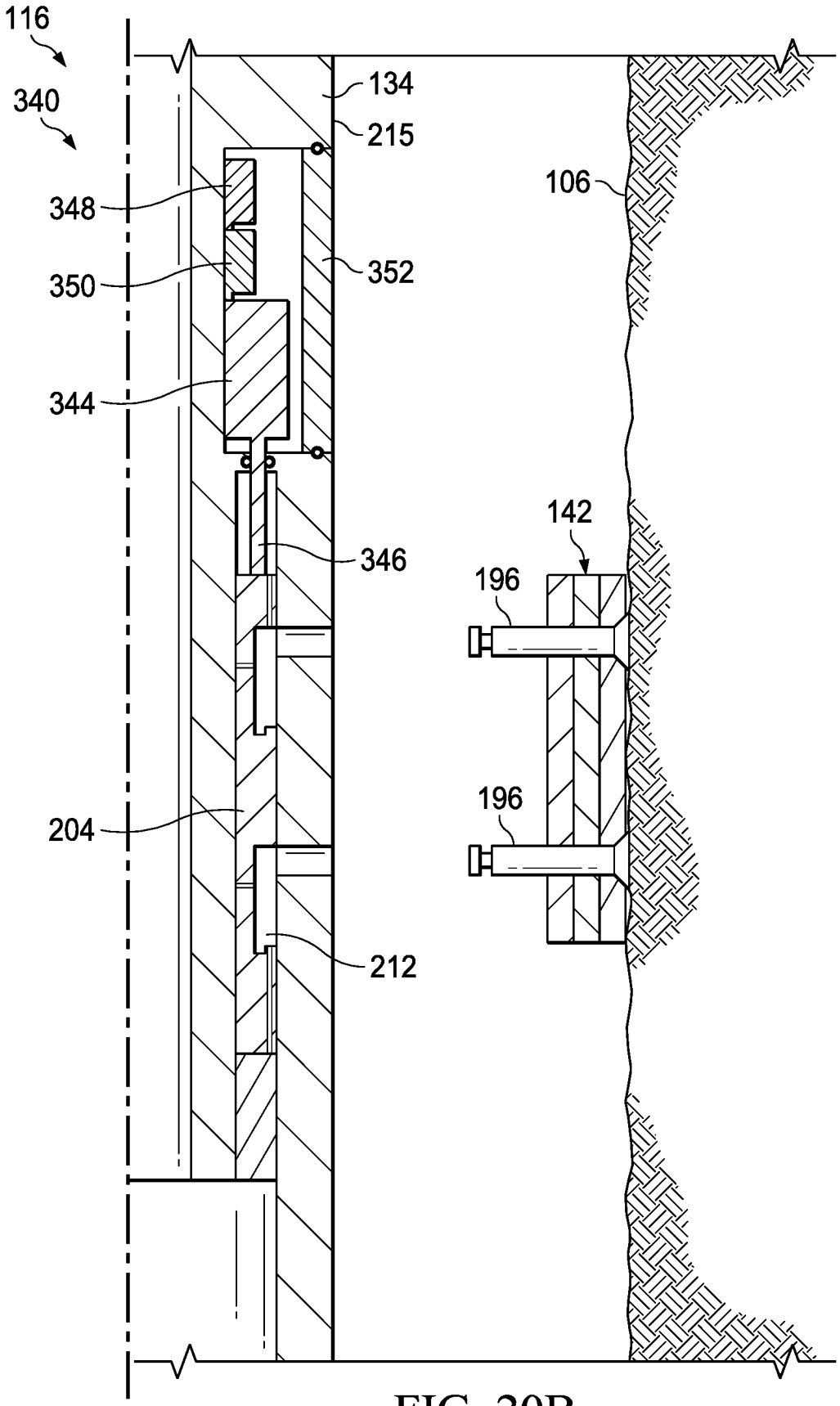

FIGS. 20A and 20B are cross-sectional side views of a spring release mechanism 340 that is substantially similar to the spring release 210. However, the spring release mechanism 340 is electronically rather than mechanically actuated. The spring release mechanism 340 includes the internal compartment 212 and the locking member 204 arranged in the internal compartment 212. The locking member 204 engages with the pins 196 of the spring ring 142 in the compressed position (FIG. 20A). The spring release mechanism 340 further includes a recess 342 arranged in the sidewall 215 of the body 134. A power module 348 and a control module 350 are disposed in the recess 342. A channel 228 connects the recess 342 to the internal compartment 212. The recess 342 is arranged on an exterior surface of the sidewall 215, uphole relative to the internal compartment 212. A solenoid actuator 344 disposed in the recess 342 includes an arm 346 that extends into the internal compartment 212 through the channel 228. The arm 346 abuts the locking member 204. In some spring release mechanisms, the arm is attached to the lock tube. The solenoid actuator 344 has a retracted state and an extended state. The retracted state is shown in FIG. 20A and the extended state is shown in FIG. 20B. Moving from the retracted state to the extended state translates or extends the arm 346 axially in the downhole direction. In some spring release mechanisms, the solenoid actuator also moves from the extended state to the retracted state. Moving from the retracted state to the extended state translates or retracts the arm axially in the uphole direction.

The spring release mechanism further includes a cover 352 that extends on the exterior wall of the body 134 to cover the recess 342. The cover 352 fluid seals the recess 342 so that the electronics (power module 348, control module 350, and solenoid actuator 344) remain dry during operation. Seals 524 sealably connect the arm 346 to the channel 228.

To actuate the spring release mechanism 340, the control module 350 receives a signal to change the state of the spring ring 142. The control module 350 then signals to the solenoid actuator to change state from the retracted position to the extended position. Moving the arm 346 axially downhole presses the locking member 204 downhole and disengages the locking member 204 from the locking pin 196. The spring ring 142 then relaxes and expands radially until the spring ring 142 abuts the wellbore 106.

Figure 21A:
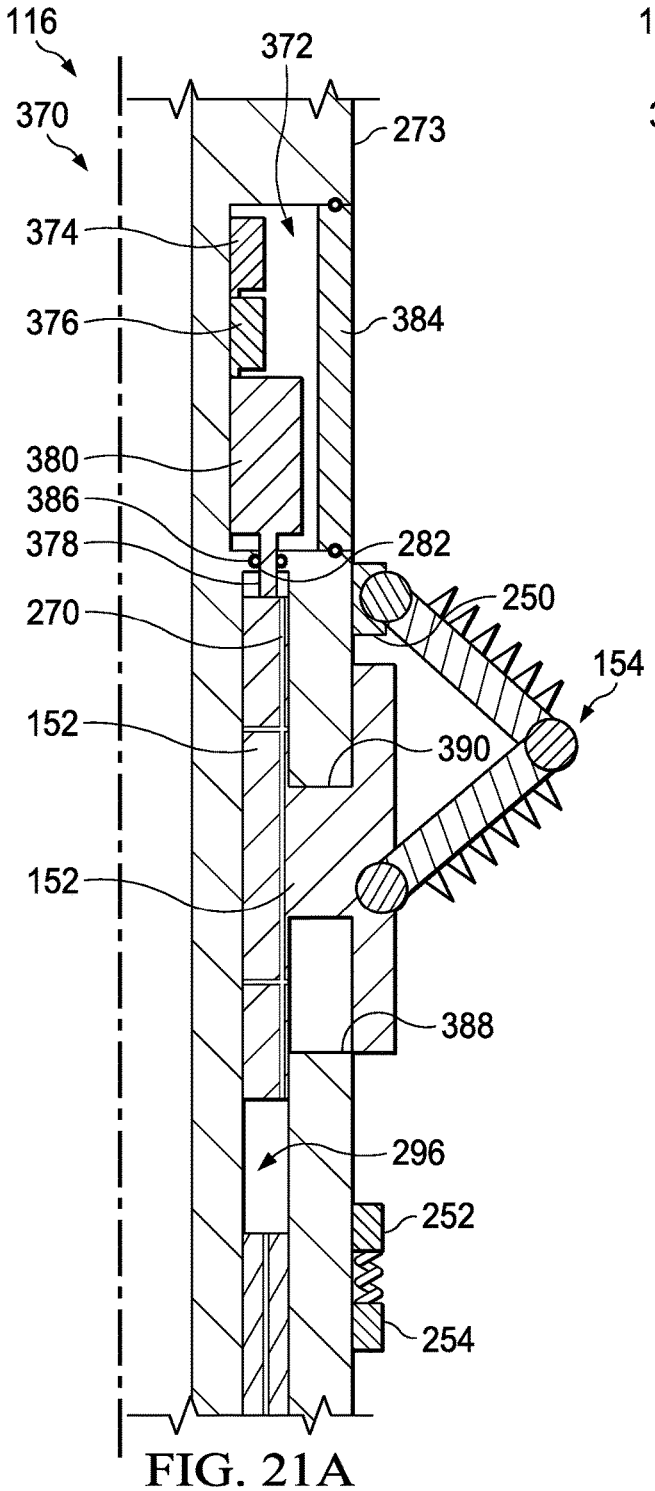
FIGS. 21A and 21B are partial cross-sectional views of a positioning mechanism.
Figure 21B:
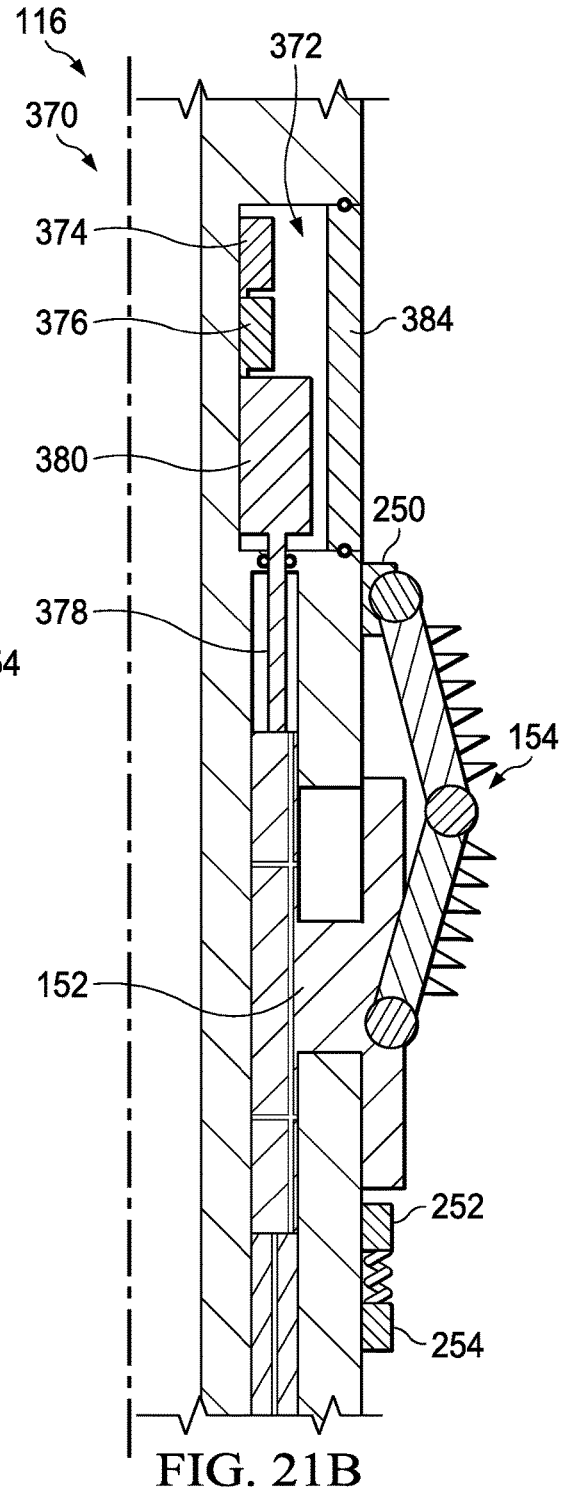

FIGS. 21A and 21B are partial cross-sectional views of a positioning mechanism 370. The positioning mechanism 370 is substantially similar to the positioning system 260. However, the positioning mechanism 370 is electronically rather than mechanically actuated. The positioning mechanism includes the first interior chamber 262 and the second interior chamber 296 defined in the body 134. The uphole end 270 of the set tube 152 is arranged in the first interior chamber 262 and the downhole end 304 of the set tube 152 is arranged in the second interior chamber 296.

The positioning mechanism 370 further includes a recess 372 arranged in an exterior wall 273 of the body 134. A power module 374 and a control module 376 are disposed in the recess 342. A channel 378 connects the recess 342 to the first interior chamber. The recess 342 is arranged on an exterior sidewall of the body 134 above the first interior chamber 262. A solenoid actuator 380 disposed in the recess 342 includes an arm 382 that extends into the first interior chamber 262 through the channel 228. The arm 382 attaches to the uphole end of 290 of the set tube 152. The solenoid actuator 380 has a retracted state and an extended state. The retracted state is shown in FIG. 21A and the extended state is shown in FIG. 21B. Moving from the retracted state to the extended state, translates or extends the arm 382 axially in the downhole direction. The solenoid actuator 380 also moves from the extended state to the retracted state. Moving from the retracted state to the extended state, translates or retracts the arm 382 axially in the uphole direction.

The positioning mechanism 370 further includes a cover 384 that extends on the exterior wall 273 of the body 134 to cover the recess 372. The cover 384 fluid seals the recess 372 so that the electronics (power module 374, control module 376, solenoid actuator 380) remain dry during operation. Seals 386 sealably connect the arm 382 to the channel 378.

To actuate the positioning mechanism 370, the control module 376 receives a signal to change the state of the combined roller-underreamer assembly 144. The control module 376 then signals to the solenoid actuator 380 to change state from the retracted position to the extended position. Moving the arm 382 axially downhole presses the set tube 152 downhole into the rolling position. The arm 382 is sized so that, when fully extended, the set tube 152 abuts a downhole stop surface 388. The combined roller-underreamer assembly 144 is then in the rolling position.

To actuate the positioning mechanism 370 a second time, the control module 376 receives a signal to change the state of the combined roller-underreamer assembly 144. The control module 376 then signals to the solenoid actuator 380 to change state from the extended position to the retracted position. Moving the arm 382 axially uphole pulls the set tube 152 uphole into the reaming position, as shown in FIG. 21A. The arm 382 is sized so that, when fully extended, the set tube 152 abuts an uphole stop surface 390. The combined roller-underreamer assembly 144 is then in the reaming position.

In some drilling systems, the body is formed with the drill pipe of the drill string and the body has no first attachment end. In some drilling systems, the body is formed with the drill bit of the drill string and the body has no second attachment end. In some systems, the second attachment end connects to a components other than the drill bit, for example a second drill pipe or other drilling tool.

In some underreamers, the control tube is arranged downhole in the reaming position and is arranged uphole in the rolling position. In some reamer arms, the central hinge is arranged such that the central hinge is closer to either the first end or the second end. In some roller arms, the central hinge is arranged such that the central hinge is closer to either the first end or the second end. In some underreamers, the first, second, and third ring are attached such that the underreamer is free to rotate relative to the body in the reaming position and is rotationally constrained to the body in the rolling position. In some underreamers the first, second, and third ring are attached such that the underreamer is free to move axially relative to the body in the rolling position and is axially constrained to the body in the reaming position.

In some bottom hole assemblies the at least one of the underreamer, the spring ring, and the spool ring is translatable and/or rotatable relative to the drill string and axially and/or rotationally lockable relative to the drill string.

In some spring rings, spikes extend from the outer surface of the spring ring to better engage the walls of the wellbore.

Some positioning and actuating mechanisms include sensors in electronic communication with a signal receiver at the surface. The sensors send positioning information to the receiver, for example, confirmation of or information about the position of the underreamer, spring ring, or spool ring. Some guide paths have patterns with more or less than 5 positions. Some guide paths include multiple patterns. Some guide paths have patterns that do not repeat or repeat a distinct number of times. Some cams are arranged on the body and some guide paths is arranged on a plate or guide tube aligned to engage the cam. The guide tube is axially constrained to the control element and finger but is free to rotate relative to the control element and finger.

Some spools rings include spool sensor that determines the presence of the fabric and/or determines if the spools are rotating.

Some bottom hole assemblies include sensors that determine the distance between the sensor and the walls of the wellbore.

Some bottom hole assemblies are rotatable relative to the drill pipe and/or drill bit.

In some bottom hole assemblies, the lost circulation fabric covers a portion of the wellbore. In some spools rings, the spools are a single spool that extends around the circumference of the base. The single spool may be coiled relative to the vertical axis so that the ends of the lost circulation fabric overlap when deployed.

A number of embodiments of the invention have been described. Nevertheless, it will be understood that various modifications may be made without departing from the spirit and scope of the invention. Accordingly, other embodiments are within the scope of the following claims.

What is claimed is:

1. A bottom hole assembly with a combined roller-underreamer assembly, the bottom hole assembly comprising:

a body configured to be attached to a drill pipe, the body having an uphole end and a downhole end;

an uphole ring attached to the body;

a downhole ring attached to the body between the uphole ring and the downhole end of the body;

a sliding ring mounted around the body between the uphole ring and the downhole ring, the sliding ring attached to the downhole ring by at least one spring;

a set tube slidably mounted around the body between the uphole ring and the sliding ring, the set tube having an uphole end and a downhole end;

a reamer assembly comprising at least one first articulated arm extending between the uphole ring and the downhole end of the set tube; and a roller assembly comprising:

at least one second articulated arm extending between the uphole end of the set tube and the sliding ring; and a roller positioned at a joint of each second articulated arm.

2. The bottom hole assembly of claim 1, wherein the set tube is moveable between a rolling position and a reaming position wherein the reaming position is between the rolling position and the uphole ring.

3. The bottom hole assembly of claim 2, wherein each second articulated arm extends radially farther from the body than each first articulated arm in the rolling position.

4. The bottom hole assembly of claim 2, further comprising an actuator to move the set tube axially along the body.

5. The bottom hole assembly of claim 4, wherein the actuator is a mechanical actuator.

6. The bottom hole assembly of claim 2, wherein each first articulated arm comprises teeth for removing portions of the wellbore.

7. The bottom hole assembly of claim 2, wherein the first articulated arms and the second articulated arms are positioned with an angular offset between the first articulated arms and the second articulated arms.

8. The bottom hole assembly of claim 7, wherein the reamer assembly has three first articulated arms with a 120 degree angular offset between the first articulated arms and the roller assembly has three second articulated arms with a 120 degree angular offset between the second articulated arms.

9. A bottom hole assembly with a combined roller-underreamer assembly, the bottom hole assembly comprising:

a body configured to be attached to a drill pipe;

a first ring attached to the body;

a second ring mechanically connected to the body, the second ring spaced apart from the first ring;

a set tube slidably mounted around the body between the first ring and the second ring;

a reamer assembly comprising at least one first articulated arm extending between the first ring and the set tube; and a roller assembly comprising:

at least one second articulated arm extending between the set tube and the second ring; and a roller positioned at a joint of each second articulated arm.

10. The bottom hole assembly of claim 9, further comprising a third ring attached to the body with the second ring between the third ring and the set tube, the third ring attached to the second ring by at least one spring such that the second ring is slidably mounted around the body.

11. The bottom hole assembly of claim 10, wherein the set tube has a first end oriented towards the first ring and a second end oriented towards the second ring and each first articulated arm extends between the first ring and the second end of the set tube.

12. The bottom hole assembly of claim 11, wherein each second articulated arm extends between the first end of the set tube and the second ring.

13. The bottom hole assembly of claim 9, wherein the set tube is moveable between a rolling position and a reaming position wherein the reaming position is between the rolling position and the first ring.

14. The bottom hole assembly of claim 13, wherein the second articulated arm extends radially farther from the body than the first articulated arm in the rolling position.

15. The bottom hole assembly of claim 13, further comprising an actuator to move the set tube axially along the body.

16. The bottom hole assembly of claim 15, wherein the actuator is a mechanical actuator.

17. The bottom hole assembly of claim 13, wherein the first articulated arm comprises teeth for removing portions of the wellbore.

18. The bottom hole assembly of claim 13, wherein the first articulated arms and the second articulated arms are positioned with an angular offset between the first articulated arms and the second articulated arms.

19. The bottom hole assembly of claim 18, wherein the reamer assembly has three first articulated arms with a 120 degree angular offset between the first articulated arms and the roller assembly has three second articulated arms with a 120 degree angular offset between the second articulated arms.

* * * * *